US007398832B2

(12) United States Patent
Brisco

(10) Patent No.: US 7,398,832 B2
(45) Date of Patent: Jul. 15, 2008

(54) MONO-DIAMETER WELLBORE CASING

(75) Inventor: David Paul Brisco, Duncan, OK (US)

(73) Assignee: Enventure Global Technology, LLC, Houston, TX (US)

( * ) Notice: Subject to any disclaimer, the term of this patent is extended or adjusted under 35 U.S.C. 154(b) by 299 days.

(21) Appl. No.: 10/518,000

(22) PCT Filed: May 5, 2003

(86) PCT No.: PCT/US03/13787

§ 371 (c)(1),
(2), (4) Date: Sep. 19, 2005

(87) PCT Pub. No.: WO03/104601

PCT Pub. Date: Dec. 18, 2003

(65) Prior Publication Data

US 2006/0096762 A1 May 11, 2006

Related U.S. Application Data

(60) Provisional application No. 60/387,486, filed on Jun. 10, 2002.

(51) Int. Cl.

| | |
|---|---|
| ***E21B 23/02*** | (2006.01) |
| ***E21B 23/04*** | (2006.01) |
| ***E21B 19/16*** | (2006.01) |
| ***E21B 33/12*** | (2006.01) |

(52) U.S. Cl. ..... 166/380; 166/122; 166/187; 166/207; 166/384; 166/387

(58) Field of Classification Search ..... None
See application file for complete search history.

(56) References Cited

U.S. PATENT DOCUMENTS 46,818 A 3/1865 Patterson (Continued)

FOREIGN PATENT DOCUMENTS

AU 767364 2/2004

(Continued)

OTHER PUBLICATIONS

Adams, "Drilling Engineering: A Complete Well Planning Approach," 1985.

(Continued)

*Primary Examiner*—Zakiya W. Bates
(74) *Attorney, Agent, or Firm*—Conley Rose, P.C.

(57) ABSTRACT

An apparatus and method for forming a monodiameter wellbore casing. The casing includes a second casing positioned in an overlapping relation to a first casing. The inside diameter of the overlapping portion and at least a portion of the second casing are substantially equal to the inside diameter of the non-overlapping portion of the first casing. The apparatus includes a support member, an adaptor coupled to the support member, an outer sleeve coupled to the adaptor, a hydraulic slip body coupled to the outer sleeve, a packer cup mandrel coupled to the hydraulic slip body, hydraulic slips coupled to the hydraulic slip body, a shoe coupled to the outer sleeve, an inner mandrel coupled to the shoe and hydraulic slip body, an expansion cone mandrel coupled to the inner mandrel, an expansion cone coupled to the expansion cone mandrel, and a guide nose coupled to the expansion cone mandrel.

43 Claims, 15 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,225,005 | A | 5/1917 | Boyd et al. |
| 1,233,888 | A | 7/1917 | Leonard |
| 1,358,818 | A | 11/1920 | Bering |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,739,932 | A | 12/1929 | Ventresca |
| 1,756,531 | A | 4/1930 | Aldeen et al. |
| 1,880,218 | A | 10/1932 | Simmons |
| 1,952,652 | A | 3/1934 | Brannon |
| 1,981,525 | A | 11/1934 | Price |
| 2,046,870 | A | 7/1936 | Clasen et al. |
| 2,087,185 | A | 7/1937 | Dillom |
| 2,110,913 | A | 3/1938 | Lowrey |
| 2,122,757 | A | 7/1938 | Scott |
| 2,134,311 | A | 10/1938 | Minor et al. |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,273,017 | A | 2/1942 | Boynton |
| 2,293,938 | A | 8/1942 | Dunn et al. |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,407,552 | A | 9/1946 | Hoesel |
| 2,447,629 | A | 8/1948 | Beissinger et al. |
| 2,481,637 | A | 9/1949 | Yancey |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,695,449 | A | 11/1954 | Chauvin |
| 2,723,721 | A | 11/1955 | Corsette |
| 2,734,580 | A | 2/1956 | Layne |
| 2,735,485 | A | 2/1956 | Metcalf, Jr. |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,331,439 | A | 7/1967 | Sanford |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Heam |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,572,777 | A | 3/1971 | Blose et al. |
| 3,574,357 | A | 4/1971 | Alexandru et al. |
| 3,578,081 | A | 5/1971 | Bodine |
| 3,579,805 | A | 5/1971 | Kast |
| 3,581,817 | A | 6/1971 | Kammerer, Jr. |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,387 | A | 9/1972 | Blackburn |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert, et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinley et al. |
| 3,789,648 | A | 2/1974 | Ames |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |

3,826,124 A 7/1974 Baksay
3,830,294 A 8/1974 Swanson
3,830,295 A 8/1974 Crowe
3,834,742 A 9/1974 McPhillips
3,848,668 A 11/1974 Sizer et al.
3,866,954 A 2/1975 Slator et al.
3,874,446 A 4/1975 Crowe
3,885,298 A 5/1975 Pogonowski
3,887,006 A 6/1975 Pitts
3,893,718 A 7/1975 Powell
3,898,163 A 8/1975 Mott
3,915,478 A 10/1975 Al et al.
3,915,763 A 10/1975 Jennings et al.
3,935,910 A 2/1976 Gaudy et al.
3,942,824 A 3/1976 Sable
3,945,444 A 3/1976 Knudson
3,948,321 A 4/1976 Owen et al.
3,963,076 A 6/1976 Winslow
3,970,336 A 7/1976 O'Sickey et al.
3,977,076 A 8/1976 Vieira et al.
3,977,473 A 8/1976 Page, Jr.
3,989,280 A 11/1976 Schwarz
3,997,193 A 12/1976 Tsuda et al.
3,999,605 A 12/1976 Braddick
4,003,433 A 1/1977 Goins
4,011,652 A 3/1977 Black
4,018,634 A 4/1977 Fenci
4,019,579 A 4/1977 Thuse
4,026,583 A 5/1977 Gottlieb
4,047,568 A 9/1977 Aulenbacher
4,053,247 A 10/1977 Marsh, Jr.
4,068,711 A 1/1978 Aulenbacher
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchinson et al.
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,629,224 A 12/1986 Lanriault
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus 4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,703,802 A 11/1987 Bryan et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.
4,739,916 A 4/1988 Ayres et al.
4,751,836 A 6/1988 Breese
4,754,781 A 7/1988 de Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Chang
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundel
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,249,628 A 10/1993 Surjaatmadja
5,253,713 A 10/1993 Gregg et al.
5,265,675 A 11/1993 Hearn et al.
RE34,467 E 12/1993 Reeves
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Bäro et al.

5,370,425 A 12/1994 Dougherty et al.
5,375,661 A 12/1994 Daneshy et al.
5,377,753 A 1/1995 Haberman et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,794,840 A 8/1998 Hohl et al.
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,887,476 A 3/1999 Damsohn et al.
5,895,079 A 4/1999 Carstensen et al.
5,899,268 A 5/1999 Lynde et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
5,985,053 A 11/1999 Hara et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani et al.
6,015,012 A 1/2000 Reddick
6,017,168 A 1/2000 Fraser et al.
6,009,611 A 2/2000 Richardson et al.
6,021,850 A 2/2000 Woo et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen et al.
6,155,613 A 12/2000 Quadflieg et al.
6,158,785 A 12/2000 Beaulier et al.
6,158,963 A 12/2000 Hollis
6,167,970 B1 1/2001 Stout 6,182,775 B1 2/2001 Hipp
6,183,013 B1 2/2001 Mackenzie et al.
6,183,573 B1 2/2001 Fujiwara et al.
6,189,616 B1 2/2001 Gano et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,230,843 B1 5/2001 Geiss
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,286,614 B1 9/2001 Gano et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,323 B1 9/2002 Metcalfe et al.
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta et al.
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup et al.
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,575,250 B1 6/2003 Wijsman
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson et al.
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman et al.
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.

6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.
6,935,429 B2 8/2005 Badrack
6,935,430 B2 8/2005 Harrell et al.
6,966,370 B2 11/2005 Cook et al.
6,968,618 B2 11/2005 Cook et al.
6,976,539 B2 12/2005 Metcalfe et al.
6,976,541 B2 12/2005 Brisco et al.
6,977,096 B2 12/2005 LeClaire
7,000,953 B2 2/2006 Berghaus
7,007,760 B2 3/2006 Lohbeck
7,011,161 B2 3/2006 Ring et al.
7,021,390 B2 4/2006 Cook et al.
7,036,582 B2 5/2006 Cook et al.
7,040,396 B2 5/2006 Cook et al.
7,044,218 B2 5/2006 Cook et al.
7,044,221 B2 5/2006 Cook et al.
7,048,062 B2 5/2006 Ring et al.
7,048,067 B1 5/2006 Cook et al.
7,055,608 B2 6/2006 Cook et al.
7,063,142 B2 6/2006 Cook et al.
7,063,149 B2 6/2006 Simpson et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,685 B2 9/2006 Cook et al.
7,114,559 B2 10/2006 Sonnier et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,164,964 B2 1/2007 Stacklies
7,185,710 B2 3/2007 Cook et al.
7,191,841 B2 3/2007 Sivley, IV
7,198,100 B2 4/2007 Cook et al.
7,201,223 B2 4/2007 Cook et al.
7,204,007 B2 4/2007 Cook et al.
7,216,701 B2 5/2007 Cook et al.
7,225,879 B2 6/2007 Wylie et al.
7,231,985 B2 6/2007 Cook et al.
7,234,531 B2 6/2007 Kendziora et al.
7,234,968 B2 6/2007 Lottmann et al.
7,240,728 B2 7/2007 Cook et al.
7,240,729 B2 7/2007 Cook et al.
7,243,731 B2 7/2007 Watson et al.
7,246,667 B2 7/2007 Cook et al.
7,258,168 B2 8/2007 Cook et al.
7,270,188 B2 9/2007 Cook et al.
7,275,601 B2 10/2007 Cook et al.
7,290,605 B2 11/2007 Waddell et al.
7,290,616 B2 11/2007 Cook et al.
2001/0002626 A1 6/2001 Frank et al.
2001/0018354 A1 8/2001 Pigni
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045646 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0195826 A1 10/2004 Goto
2004/0216506 A1 11/2004 Simpson et al.
2004/0216873 A1 11/2004 Frost, Jr. et al.
2004/0221996 A1 11/2004 Burge
2004/0231839 A1 11/2004 Ellington et al.

2004/0231843 A1 11/2004 Simpson et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring et al.
2005/0217866 A1 10/2005 Watson et al.
2005/0223535 A1 10/2005 Cook et al.
2005/0224225 A1 10/2005 Cook et al.
2005/0230102 A1 10/2005 Cook et al.
2005/0230103 A1 10/2005 Cook et al.
2005/0230104 A1 10/2005 Cook et al.
2005/0230123 A1 10/2005 Cook et al.
2005/0236159 A1 10/2005 Cook et al.
2005/0236163 A1 10/2005 Cook et al.
2005/0244578 A1 11/2005 Van Egmond et al.
2005/0246883 A1 11/2005 Alliot et al.
2005/0247453 A1 11/2005 Shuster et al.
2005/0265788 A1 12/2005 Renkema
2005/0269107 A1 12/2005 Cook et al.
2006/0027371 A1 2/2006 Gorrara
2006/0032640 A1 2/2006 Costa et al.
2006/0048948 A1 3/2006 Noel
2006/0054330 A1 3/2006 Metcalfe et al.
2006/0065403 A1 3/2006 Watson et al.
2006/0065406 A1 3/2006 Shuster et al.
2006/0096762 A1 5/2006 Brisco
2006/0102360 A1 5/2006 Brisco et al.
2006/0112768 A1 6/2006 Shuster et al.
2006/0113086 A1 6/2006 Costa et al.
2006/0266527 A1 11/2006 Brisco et al.
2006/0272826 A1 12/2006 Shuster et al.
2007/0131431 A1 6/2007 Shuster et al.
2007/0143987 A1 6/2007 Cook et al.
2007/0144735 A1 6/2007 Lloyd et al.
2007/0151360 A1 7/2007 Ring et al.
2007/0151725 A1 7/2007 Cook et al.
2007/0154270 A1 7/2007 Waddell et al.
2007/0169939 A1 7/2007 Costa et al.
2007/0169944 A1 7/2007 Parker et al.
2007/0175630 A1 8/2007 Costa et al.
2007/0227730 A1 10/2007 Brisco et al.
2007/0246934 A1 10/2007 Heertjes et al.

FOREIGN PATENT DOCUMENTS

AU 773168 5/2004
AU 2004/202805 B9 7/2004
AU 2004/202809 B8 7/2004
AU 2004/202812 B8 7/2004
AU 2004/202813 B2 7/2004
AU 2004/202815 B2 7/2004
AU 770008 7/2004
AU 770359 7/2004
AU 771884 8/2004
AU 776580 1/2005
AU 780123 3/2005
AU 2001269810 8/2005
AU 782901 9/2005
AU 783245 10/2005
AU 2001294802 10/2005
AU 2001283026 7/2006
AU 2002239857 8/2006
AU 2001/292695 B2 10/2006
AU 2001292695 10/2006
AU 2003/257878 B2 8/2007
AU 2003/257881 B2 8/2007
CA 736288 6/1966
CA 771462 11/1967
CA 1171310 7/1984
CA 2292171 6/2000
CA 2298139 8/2000
CA 2419806 4/2002
CA 2453034 1/2003
CA 2234386 3/2003
CA 2466685 3/2004
CA 2414449 9/2006
CA 2249139 1/2007
CA 2289811 1/2007
CA 2536716 A1 7/2007
DE 174521 4/1953
DE 1549823 12/1970
DE 1549824 5/1971
DE 2458188 12/1980
DE 203767 11/1983
DE 233607 A1 3/1986
DE 278517 A1 5/1990
EP 0084940 A1 8/1983
EP 0272511 12/1987
EP 0294264 5/1988
EP 0553566 A1 12/1992
EP 620289 A1 10/1994
EP 0633391 A2 1/1995
EP 0713953 B1 11/1995
EP 0823534 2/1998
EP 0881354 12/1998
EP 0881359 12/1998
EP 0899420 3/1999
EP 0937861 8/1999
EP 0952305 10/1999
EP 0952306 10/1999
EP 1106778 A1 6/2001
EP 1141515 A 10/2001
EP 1152119 A2 11/2001
EP 1152120 A2 11/2001
EP 1152120 A3 11/2001
EP 1375820 A1 3/2002
EP 1235972 A 9/2002
EP 1306519 A2 5/2003
EP 1505251 A2 2/2005
EP 1555386 A1 7/2005
EP 1505251 A3 2/2007
EP 1549824 B1 7/2007
FR 1325596 6/1962
FR 1325596 3/1963

| | | | |
|---|---|---|---|
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1107902 | A | 3/1968 |
| GB | 1111536 | | 5/1968 |
| GB | 1448304 | | 9/1976 |
| GB | 1460864 | | 1/1977 |
| GB | 1542847 | | 3/1979 |
| GB | 1549823 | | 8/1979 |
| GB | 1549824 | | 8/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2124275 | A | 2/1984 |
| GB | 2125876 | A | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2275705 | A | 9/1994 |
| GB | 2279383 | | 1/1995 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2331103 | A | 5/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2345308 | A | 7/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2350137 | A | 11/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2385622 | A | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396634 | A | 6/2004 |
| GB | 2396635 | A | 6/2004 |
| GB | 2396639 | A | 6/2004 |
| GB | 2396640 | A | 6/2004 |
| GB | 2396641 | A | 6/2004 |
| GB | 2396642 | A | 6/2004 |

| | | | |
|---|---|---|---|
| GB | 2396643 | A | 6/2004 |
| GB | 2396644 | A | 6/2004 |
| GB | 2396646 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404402 | A | 2/2005 |
| GB | 2404676 | A | 2/2005 |
| GB | 2404677 | A | 2/2005 |
| GB | 2404680 | A | 2/2005 |
| GB | 2384807 | C | 3/2005 |
| GB | 2387861 | B | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2 403970 | B | 8/2005 |
| GB | 2398326 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2396639 | B | 3/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |

| | | | |
|---|---|---|---|
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2421257 | B | 8/2006 |
| GB | 2421258 | B | 8/2006 |
| GB | 2422859 | A | 8/2006 |
| GB | 2422860 | A | 8/2006 |
| GB | 2422860 | A | 8/2006 |
| GB | 2423317 | | 8/2006 |
| GB | 2404676 | B | 9/2006 |
| GB | 2414493 | B | 9/2006 |
| GB | 2424077 | A | 9/2006 |
| GB | 2427636 | A | 1/2007 |
| GB | 2429482 | A | 2/2007 |
| GB | 2410280 | B | 4/2007 |
| GB | 2430953 | A | 4/2007 |
| GB | 2431179 | A | 4/2007 |
| GB | 2431181 | A | 4/2007 |
| GB | 2412178 | B | 5/2007 |
| GB | 2415215 | B | 5/2007 |
| GB | 2426993 | B | 5/2007 |
| GB | 2427636 | B | 5/2007 |
| GB | 2432383 | A | 5/2007 |
| GB | 2432384 | A | 5/2007 |
| GB | 2432385 | A | 5/2007 |
| GB | 2432386 | A | 5/2007 |
| GB | 2415003 | B | 6/2007 |
| GB | 2416556 | B | 7/2007 |
| GB | 2433756 | A | 7/2007 |
| GB | 2415454 | B | 8/2007 |
| GB | 2429226 | B | 8/2007 |
| GB | 2429996 | B | 8/2007 |
| GB | 2433281 | B | 8/2007 |
| GB | 2435280 | A | 8/2007 |
| GB | 2415983 | B | 9/2007 |
| GB | 2415987 | B | 9/2007 |
| GB | 2416361 | B | 9/2007 |
| GB | 2421529 | B | 9/2007 |
| GB | 2429480 | B | 9/2007 |
| GB | 2429482 | B | 9/2007 |
| GB | 2436114 | A | 9/2007 |
| GB | 2415988 | B | 10/2007 |
| GB | 2424437 | B | 10/2007 |
| GB | 2427886 | B | 10/2007 |
| GB | 2429481 | B | 10/2007 |
| GB | 2432388 | B | 10/2007 |
| GB | 2433757 | B | 10/2007 |
| GB | 2433758 | B | 10/2007 |
| GB | 2435064 | B | 10/2007 |
| GB | 2436931 | A | 10/2007 |
| GB | 2437045 | A | 10/2007 |
| GB | 2437467 | A | 10/2007 |
| GB | 2416794 | B | 11/2007 |
| GB | 2429224 | B | 11/2007 |
| GB | 2429225 | B | 11/2007 |
| GB | 2436743 | B | 11/2007 |
| GB | 2437044 | B | 11/2007 |
| GB | 2437879 | A | 11/2007 |
| GB | 2437880 | A | 11/2007 |
| GB | 2408277 | A | 5/2008 |
| ID | P01.012.197/2005 | | 1/2005 |
| ID | 09.044.392/2005 | | 9/2005 |
| ID | 044.392/2005 | | 9/2005 |
| ID | 09.046.2804/2006 | | 8/2006 |
| JP | 59-197323 | | 11/1984 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| JP | P2001-47161 | A | 2/2001 |
| JP | 2006-525483 | | 8/2007 |
| NL | 6505793 | A | 11/1965 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |

| | | | |
|---|---|---|---|
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO 93/25800 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO 96/10710 | | 11/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO 98/22690 | | 5/1998 |
| WO | WO98/26152 | | 6/1998 |
| WO | WO98/42947 | | 10/1998 |
| WO | WO 98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO 00/08301 | | 2/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37767 | | 6/2000 |
| WO | WO00/37768 | | 6/2000 |
| WO | WO00/37771 | | 6/2000 |
| WO | WO 00/37771 | A1 | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO 01/18354 | A1 | 3/2001 |
| WO | WO01/18354 | A1 | 3/2001 |
| WO | WO01/21929 | A1 | 3/2001 |
| WO | WO01/26860 | A1 | 4/2001 |
| WO | WO 01/33037 | A1 | 5/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO 01/98623 | A1 | 12/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO 02/38343 | A2 | 5/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO 03/023178 | A2 | 3/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO 03/093623 | A2 | 11/2003 |
| WO | WO03/093623 | A3 | 11/2003 |

| | | | |
|---|---|---|---|
| WO | WO 03/093624 | | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO 2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO 2004/027201 | A2 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO 2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020810 | A3 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2004/089608 | A3 | 7/2006 |
| WO | WO2006/079072 | A2 | 7/2006 |
| WO | WO2006/088743 | A2 | 8/2006 |
| WO | WO 2006/096762 | A1 | 9/2006 |
| WO | WO2006/102171 | A2 | 9/2006 |
| WO | WO2006/102556 | A2 | 9/2006 |
| WO | WO 2007/047193 | A2 | 4/2007 |
| WO | WO 2007/076078 | A2 | 7/2007 |
| WO | WO 2007/079321 | A2 | 7/2007 |

OTHER PUBLICATIONS

Dupal et al., "Well Design with Expandable Tubulars Reduces Cost and Increases Success in Deepwater Applications," *Deep Offshore Technology*, 2000.

Flatern, "Oilfield Service Trio Target Jules Verne Territory," at http://www.oilonline.com.

Harris, "Tube Welding." At http://www.tubenet.org.uk.technical.ewi.html.

"Pipeline Rehabilitation by Sliplining with Polyethylene Pipe" 2006.

www.RIGZONE.com/news/article.asp?a_id=1755, "Tesco Provides Casing Drilling Operations Update," 2001.

www.RIGZONE.com/news/article.asp?a_id=2603, Conoco and Tesco Unveil Revolutionary Drilling Rig 2002.

"Expand Your Opportunities." *Enventure*. CD-ROM. Jun. 1999.

"Expand Your Opportunities." *Enventure*. CD-ROM. May 2001.

International Search Report, Application PCT/US03/15020, Nov. 14, 2005.

International Preliminary Examination Report, Application PCT/US01/28690, Sep. 4, 2003.

International Preliminary Report on Patentability, Application PCT/US04/00631, Mar. 2, 2006.

International Preliminary Report on Patentability, Application PCT/US04/04740, Jun. 27, 2006.

International Preliminary Report on Patentability, Application PCT/US04/10317, Jun. 23, 2006.

International Preliminary Report on Patentability, Application PCT/US04/028423, Mar. 9, 2006.

International Preliminary Report on Patentability, Application PCT/US04/028423, Jun. 19, 2006.

International Preliminary Report on Patentability, Application PCT/US04/28889, Aug. 1, 2006.

Combined Search Report and Written Opinion to Application No. PCT/US04/07711, Nov. 28, 2006.

Combined Search Report and Written Opinion to Application No. PCT/US04/10317, May 25, 2006.

Combined Search Report and Written Opinion to Application No. PCT/US05/28473, Sep. 1, 2006.

Combined Search Report and Written Opinion to Application No. PCT/US05/28642, Jul. 14, 2006.

Combined Search Report and Written Opinion to Application No. PCT/US05/28819, Aug. 3, 2006.

Combined Search Report and Written Opinion to Application No. PCT/US05/28869, Apr. 17, 2006.

Combined Search Report and Written Opinion to Application No. PCT/US06/04809, Aug. 29, 2006.
Combined Search Report and Written Opinion to Application No. PCT/US06/09886, Dec. 4, 2006.
Search Report to Application No. GB 0507980.1, Apr. 24, 2006.
Examination Report to Application No. GB 0219757.2, Oct. 31, 2004.
Examination Report to Application No. GB 03701281.2, Jan. 31, 2006.
Examination Report to Application No. GB 03723674.2, Feb. 6, 2006.
Examination Report to Application No. GB 0406257.6, Sep. 2, 2005.
Examination Report to Application No. GB 0406257.6, Nov. 9, 2005.
Examination Report to Application No. GB 0406257.6, Apr. 28, 2006.
Examination Report to Application No. GB 0408672.4, Jul. 12, 2004.
Examination Report to Application No. GB 0412876.5, Feb. 13, 2006.
Examination Report to Application No. GB 0428141.6, Feb. 21, 2006.
Examination Report to Application No. GB 0428141.6, Jul. 18, 2006.
Examination Report to Application No. GB 0500184.7, Sep. 12, 2005.
Examination Report to Application No. GB 0500275.3, Apr. 5, 2006.
Examination Report to Application No. GB 0501667.0, Jan. 27, 2006.
Examination Report to Application No. GB 0503250.3, Mar. 2, 2006.
Examination Report to Application No. GB 0503250.3, Aug. 11, 2006.
Examination Report to Application No. GB 0506699.8, May 11, 2006.
Examination Report to Application No. GB 0506700.4, May 16, 2006.
Examination Report to Application No. GB 0506702.0, May 11, 2006.
Examination Report to Application No. GB 0506702.0, Jul. 24, 2006.
Examination Report to Application No. GB 0507979.3, Jan. 17, 2006.
Examination Report to Application No. GB 0507979.3, Jun. 6, 2006.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509630.0, May 11, 2006.
Examination Report to Application No. GB 0509630.0, Jun. 6, 2006.
Examination Report to Application No. GB 0509631.8, Feb. 14, 2006.
Examination Report to Application No. GB 0517448.7, Nov. 9, 2005.
Examination Report to Application No. GB 0517448.7, Jul. 19, 2006.
Examination Report to Application No. GB 0518025.2, May 25, 2006.
Examination Report to Application No. GB 0518039.3, Aug. 2, 2006.
Examination Report to Application No. GB 0518252.2, May 25, 2006.
Examination Report to Application No. GB 0518799.2, Jun. 14, 2006.
Examination Report to Application No. GB 0518893.3, Jul. 28, 2006.
Examination Report to Application No. GB 0519989.8, Mar. 8, 2006.
Examination Report to Application No. GB 0521931.6, Nov. 8, 2006.
Examination Report to Application No. GB 0522892.9, Aug. 14, 2006.
Examination Report to Application No. GB 0602877.3, Mar. 20, 2006.
Examination Report to Application No. GB 0603576.0, Apr. 5, 2006.
Examination Report to Application No. GB 0603576.0, Nov. 9, 2006.
Examination Report to Application No. GB 0603656.0, May 3, 2006.
Examination Report to Application No. GB 0603656.0, Nov. 10, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0507980.1, Jun. 20, 2006.
Search and Examination Report to Application No. GB 0522155.1, Mar. 7, 2006.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Search and Examination Report to Application No. GB 0602877.3, Sep. 25, 2006.
Search and Examination Report to Application No. GB 0609173.0, Jul. 19, 2006.
Search and Examination Report to Application No. GB 0613405.0, Nov. 2, 2006.
Search and Examination Report to Application No. GB 0613406.8, Nov. 2, 2006.
Examination Report to Application No. AU 2003257878, Jan. 30, 2006.
Examination Report to Application No. AU 2003257881, Jan. 30, 2006
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examinaton Report to Application No. AU 2004202813, Jun. 14, 2006.
Examination Report to Application No. AU 2004202815, Jun. 14, 2006.
Search Report to Application No. EP 03071281.2; Nov. 14, 2005.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03752486.5; Feb. 8, 2006.
Examination Report to Application No. EP 03752486.5; Jun. 28, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006
Examination Report to Application No. Norway 2002 1613, May 13, 2006.
Examination Report to Application No. Norway 20023885, May 29, 2006.
Examination Report To Application No. Canada 2298139, Nov. 15, 2006.
Baker Hughes, "Expatch Expandable Cladding System," Oct. 2002.
Baker Hughes, "Express Expandable Screen System."
Baker Hughes, "Formlock Expandable Liner Hangers."
Banabic, "Research Projects," Jan. 30, 1999.
Cales et al., "Subsidence Remediation—Extending Well Life Through the Use of Solid Expandable Casing Systems," *AADE Houston Chapter*, Mar. 27, 2001.
Case History, "Eemskanaal—2 Groningen," Enventure Global Technology, Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.

Case History, "Mississippi Canyon 809 URSA TLP, OSC-G 5868, No. A-12," Enventure Global Technology, Mar. 2004.
Case History, "Yibal 381 Oman," Enventure Global Technology, Feb. 2002.
Data Sheet, "Enventure Openhole Liner (OHL) System" Enventure Global Technology, Dec. 2002.
Duphorne, "Letter Re: Enventure Claims of Baker Infringement of Enventure's Expandable Patents," Apr. 1, 2005.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
"Expandable Casing Accesses Remote Reservoirs," *Petroleum Engineer International*, Apr. 1999.
Fraunhofer Iwu, "Research Area: Sheet Metal Forming—Superposition of Vibrations," 2001.
"Innovators Chart the Course."
Linzell, "Trib-Gel A Chemical Cold Welding Agent," 1999.
Mohawk Energy, :Minimizing Drilling Ecoprints Houston, Dec. 16, 2005.
News Release, "Shell and Halliburton Agree to Form Company to Develop and Market Expandable Casing Technology," Jun. 3, 1998.
Sanders et al., Practices for Providing Zonal Isolation in Conjunction with Expandable Casing Jobs-Case Histories, 2003.
"Set Technology: The Facts" 2004.
"Slim Well:Stepping Stone to MonoDiameter," *Hart's E& P*, Jun. 2003.
www.MITCHMET.com, "3d Surface Texture Parameters," 2004.
www.SPURIND.com, "Glavanic Protection, Metallurgical Bonds, Custom Fabrications—Spur Industries," 2000.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US02/39425, Nov. 16, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005, (Corrected).
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/15020 (corrected), Nov. 14, 2004.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/28438, Sep. 20, 2005.
Written Opinion to Application No. PCT/US03/25675, May 9, 2005.
Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28831, Dec. 19, 2005.
Combined Search Report and Written Opinion to Application No. PCT/US04/28889, Nov. 14, 2005.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0400018.8, May 17, 2005.
Examination Report to Application No. GB 0400019.6, Sep. 2, 2005.
Examination Report to Application No. GB 0400019.6, Nov. 4, 2005.
Examination Report to Application No. GB 0404833.6, Aug. 19, 2004.
Examination Report to Application No. GB 0406258.4, Jul. 27, 2005.
Examination Report to Application No. GB 0416834.0 Nov. 16, 2004.
Examination Report to Application No. GB 0422419.2, Dec. 8, 2004.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 9, 2005.
Examination Report to Application No. GB 0428141.6 Sep. 15, 2005.
Examination Report to Application No. GB 0500600.2, Sep. 6, 2005.
Examination Report to Application No. GB 0503250.3, Nov. 15,2 005.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Examination Report to Application No. GB 0507980.1, Sep. 29, 2005.
Examination Report to Application No. GB 0518025.2, Oct. 27, 2005.

Examination Report to Application No. GB 0518039.3 Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0521024.0 Dec. 22, 2005.
Examination Report to Application No. GB 0522050.4, Dec. 13, 2005.
Search and Examination Report to Application No. GB 0412876.5, Sep. 27, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1 Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3 July 26, 2005.
Search and Examination Report to Application No. GB 0512398.9, Jul. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9 Jan. 12, 2006.
Search and Examination Report to Application No. GB 0524692.1, Dec. 19, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Examination Report to Application No. AU 2003257878, Jan. 19, 2006.
Examination Report to Application No. AU 2003257881, Jan. 19, 2006.
Search Report to Application No. EP 02806451.7; Feb. 9, 2005.
Search Report to Application No. EP 03723674.2; Nov. 22, 2005.
Search Report to Application No. Norway 1999 5593, Aug. 20, 2002.
Halliburton Energy Services, "Halliburton Completion Products" 1996, Page Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects; "Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including. ." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.

International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Examination Report, Application PCT/US02/24399, Aug. 6, 2004.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Examination Report, Application PCT/US02/36267, Jan. 4, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Examination Report, Application PCT/US03/04837, Dec. 9, 2004.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Search Report, Application PCT/US03/11765; Nov. 13, 2003.
International Examination Report, Application PCT/US03/11765; Dec. 10, 2004.
International Search Report, Application PCT/US03/13787; May 28, 2004.
International Search Report, Application PCT/US03/14153; May 28, 2004.
International Search Report, Application PCT/US03/15020; Jul. 30, 2003.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/20870; Sep. 30, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Examination Report, Application PCT/US03/29859, Aug. 16, 2004.
International Search Report, Application PCT/US03/38550; Jun. 15, 2004.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Search Report to Application No. GB 0004285.3, Aug. 28, 2002.
Examination Report to Application No. 0004285.3, Mar. 28, 2003.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4, 2003.
Examination Report to Application No. GB 0208367.3, No. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application GB 0220872.6, Mar. 13, 2003.
Examination Report to Application GB 0220872.6, Oct. 29, 2004.
Search Report to Application No. GB 0225505.7, Mar. 5, 2003.
Search and Examination Report to Application No. GB 0225505.7, Jul. 1, 2003.
Examination Report to Application No. GB 0225505.7, Oct. 27, 2004.
Examination Report to Application No. GB 0300085.8, Nov. 28, 2003.
Examination Report to Application No. GB 030086.6, Dec. 1, 2003.
Examination Report to Application No. GB 0306046.4, Sep. 10, 2004.

Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Examination Report to Application No. GB 0314846.7, Jul. 15, 2004.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0400018.8; Oct. 29, 2004.
Examination Report to Application No. GB 0400019.6; Oct. 29, 2004.
Search and Examination Report to Application No. GB 0403891.5, Jun. 9, 2004.
Search and Examination Report to Application No. GB 0403893.1, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.

Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0404830.2, Aug. 17, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search Report to Application No. GB 0415835.8, Dec. 2, 2004.
Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Search Report to Application No. Norway 1999 5593, Aug. 20, 2002.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25675 Nov. 24, 2004.
Written Opinion to Application No. PCT/US02/25727; May 17, 2004.
Written Opinion to Application No. PCT/US02/39418; Jun. 9, 2004.
Written Opinion to Application No. PCT/US02/39425; Nov. 22, 2004.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/38550 Dec. 10, 2004.
Combined Search Report and Written Opinion to Application No. PCT/US04/08030 Jan. 6, 2005.
Letter From Baker Oil Tools to William Norvell in Regards to Enventure's Claims of Baker Infringement Of Enventure's Expandable Patents Apr. 1, 2005.
Hart's E & P, "SET Technology: Setting the Standard" Mar. 2002.
Hart's E & P, "An Expanded Horizon" Jim Brock, Lev Ring, Scott Costa, Andrei Filippov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence, No. 2878 . pp. 50-52, 3 Juillet 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine- the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultradeepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.

Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Well in South Texas" Sumrow, Mike., Oct 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999. pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Cased-hole Liner Remediates Prolific Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemers Gertjan, et al., 2003.
"Practices for Providing Zonal Isolation in Conjuction with Expandable Casing Jobs-Case Histories" Sanders, T, et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners-Summary of Case Histories" Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al.,2004.
Deep Offshore Technology Conference "Meeting Economic Challenges of Deepwater Drilling with Expandable-Tubular Technology" Haut, Richard, et al., 1999.
Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.
Society of Petroleum Engineers, "Changing Safety Paradigms in the Oil and Gas Industry" Ratilff, Matt, et al., 2004.
"Casing Remediation-Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: The Value of Planned Installations vs. Contingency", Carstens, Chris, et al.
Data Sheet, "Enventure Cased-Hole Liner (CHL) System" Enventure Global Technology, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.

Case History, "Eemskanaal—2 Groningen" Enventure Global Technology, Feb. 2. 2002
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
"Expand Your Opportunities." *Enventure*. CD-ROM. Jun. 1999.
"Expand Your Opportunities." *Enventure*. CD-ROM, May 2001.
International Examination Report, Application PCT/US02/25608; Jun. 1, 2005.
International Examination Report, Application PCT/US02/39418, Feb. 18, 2005.
International Examination Report, Application PCT/US03/06544, May 10, 2005.
Examination Report, Application PCT/US03/10144; Jul. 7, 2004.
International Examination Report, Application PCT/US03/11765;; Jan. 25, 2005.
International Examination Report, Application PCT/US03/11765; Jul. 18, 2005.
International Examination Report, Application PCT/US03/13787; Apr. 7, 2005.
International Examination Report, Application PCT/US03/13787; Mar. 2, 2005.
International Examination Report, Application PCT/US03/14153; May 12, 2005.
International Examination Report, Application PCT/US03/15020, May 9, 2005.
International Examination Report, Application PCT/US03/25667, May 25, 2005.
International Search Report, Application PCT/US03/25716; Jan. 13, 2005.
International Examination Report, Application PCT/US03/29858; May 23, 2005.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Examination Report to Application No. GB 0225505.7 Feb. 15, 2005.
Examination Report to Application No. GB 0400019.6; May 19, 2005.
Examination Report to Application No. GB 0403891.5, Feb. 14, 2005.
Examination Report to Application No. GB 0403891.5, Jun. 30, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5; Apr. 14, 2005.
Examination Report to Application No. GB 0406257.6, Jan. 25, 2005.
Examination Report to Application No. GB 0406257.6 Jun. 16, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Examination Report to Application No. GB 0411692.3, Feb. 21, 2005.
Examination Report to Application No. GB 0412533.2, May 20, 2005.
Search Report to Application No. GB 0415835.8; Mar. 10, 2005.
Examination Report to Application No. 0416625.2 Jan. 20, 2005.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Search and Examination Report to Application No. GB 0507979.3 Jun. 16, 2005.
Written Opinion to Application No. PCT/US02/39425; Apr. 11, 2005.
Written Opinion to Application No. PCT/US03/06544; Feb. 18, 2005.
Written Opinion to Application No. PCT/US03/25675 May 9, 2005.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
Examination Report dated Nov. 12, 2007 on Australian Patent Application No. 2002301204.

Examination Report dated Nov. 12, 2007 on Australian Patent Application No. 2002301542.
Examination Report dated Oct. 13, 2006 on Australian Patent Application No. 200400246.
Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Oct. 16, 2007 on Brazilian patent application No. PI 0003319-7.
Examination Report dated Nov. 13, 2007 on Canadian Patent Application No. 2397480.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Oct. 11, 2007 on European Patent Application No. 2806451.7.
Examination Report dated Jul. 4, 2007 on European Patent Application No. 3728326.4.
Examination Report dated Apr. 2, 2007 on European Patent Application No. 3701281.2.
Examination Report dated Jan. 10, 2007 on European Patent Application No. 3723674.2.
Examination Report dated Sep. 14, 2007 on German Patent Application No. 199 58 399.4-24.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated Aug. 7, 2007 on British Patent application No. 613924.0.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated Aug. 7, 2007 on British patent application No. 613924.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.
Examination Report dated Jun. 22, 2007 on British patent application No. 609173.
Examination Report dated Sep. 14, 2007 on British patent application No. 623634.3.
Examination Report dated Jul. 5, 2007 on British patent application No. 624328.1.
Examination Report dated Sep. 4, 2007 on British patent application No. 624328.1.
Examination Report dated Oct. 26, 2007 on British patent application No. 624328.1.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 2007 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.
Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
Search and Examination Report dated Aug. 2, 2007 on British Patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.

Search and Examination Report dated Mar. 15, 2007 on British patent application No. 6043593.
Search and Examination Report dated Mar. 15, 2007 on British patent application No. 604360.8.
Search Report dated Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116.
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.

MONO-DIAMETER WELLBORE CASING

CROSS REFERENCE TO RELATED APPLICATIONS

The present application claims the benefit of the filing dates of (1) U.S. provisional patent application Ser. No. 60/387,486, filed on Jun. 10, 2002, the disclosure of which is incorporated herein by reference.

The present application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. patent application Ser. No. 09/969,922, filed on Oct. 3, 2001, (30) U.S. patent application Ser. No. 10/016,467, filed on Dec. 10, 2001; (31) U.S. provisional patent application Ser. No. 60/343,674, filed on Dec. 27, 2001; (32) U.S. provisional patent application Ser. No. 60/346,309, filed on Jan. 7, 2002; (33) U.S. provisional patent application Ser. No. 60/372,048, filed on Apr. 12, 2002; (34) U.S. provisional patent application Ser. No. 60/372,632, filed on Apr. 15, 2002; and (35) U.S. provisional patent application Ser. No. 60/380,147, filed on May 6, 2002, the disclosures of which are incorporated herein by reference.

BACKGROUND OF THE INVENTION

This invention relates generally to oil and gas exploration, and in particular to forming and repairing wellbore casings to facilitate oil and gas exploration and production.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing processes for forming and repairing wellbore casings.

SUMMARY OF THE INVENTION

According to one aspect of the present invention, a method of forming a mono diameter wellbore casing within a borehole that traverses a subterranean formation is provided that includes positioning a first wellbore casing within the borehole, radially expanding and plastically deforming the first wellbore casing within the borehole, positioning a second wellbore casing within the borehole in overlapping relation to the first wellbore casing, radially expanding and plastically deforming the second wellbore casing within the borehole, radially expanding and plastically deforming the overlapping portions of the first and second wellbore casings, and radially expanding and plastically deforming at least a portion of the second wellbore casing that does not overlap with the first wellbore casing. The inside diameter of the portion of the first wellbore casing that does not overlap with the second wellbore casing is substantially equal to the inside diameter of the radially expanded and plastically deformed portions of the second wellbore casing. an apparatus and method for forming a mono diameter wellbore casing is provided.

According to another aspect of the present invention, an apparatus for forming a mono diameter wellbore casing is provided that includes means for positioning a first wellbore casing within the borehole, means for radially expanding and plastically deforming the first wellbore casing within the borehole, means for positioning a second wellbore casing within the borehole in overlapping relation to the first wellbore casing, means for radially expanding and plastically deforming the second wellbore casing within the borehole, means for radially expanding and plastically deforming the overlapping portions of the first and second wellbore casings, and means for radially expanding and plastically deforming at least a portion of the second wellbore casing that does not overlap with the first wellbore casing, wherein the inside diameter of the portion of the first wellbore casing that does not overlap with the second wellbore casing is substantially equal to the inside diameter of the radially expanded and plastically deformed portions of the second wellbore casing.

According to another aspect of the present invention, an apparatus for radially expanding and plastically deforming a tubular member is provided that includes a tubular adapter defining a longitudinal passage, a tubular outer sleeve coupled to the tubular adapter defining a longitudinal passage, a tubular hydraulic slip body coupled to the tubular outer sleeve defining a plurality of L-shaped bypass ports and a plurality of radial hydraulic slip mounting passages, a plurality of hydraulic slips movably coupled and positioned within corresponding radial hydraulic slip mounting passages for engaging the tubular member, a tubular packer cup mandrel coupled to the tubular hydraulic slip body defining a longitudinal passage, a plurality of packer cups coupled to the tubular packer cup mandrel for sealingly engaging the tubular member, a tubular shoe positioned within and movably coupled to the tubular outer sleeve defining a longitudinal passage, a tubular inner mandrel positioned within and movably coupled to the tubular hydraulic slip body coupled to the tubular shoe defining a longitudinal passage and a plurality of radial bypass ports, a tubular expansion cone mandrel coupled to the tubular inner mandrel defining a longitudinal passage having a throat passage for receiving a ball, an L-shaped bypass port, and a radial pressure port, a tubular expansion cone coupled to the tubular expansion cone including a tapered outer expansion surface for radially expanding and plastically deforming the tubular member, a tubular guide nose coupled to the tubular expansion cone mandrel defining a longitudinal passage, a bypass tube positioned within the tubular inner mandrel coupled to the expansion cone mandrel and the tubular shoe defining a longitudinal passage, and an annular longitudinal bypass passage defined between the tubular inner mandrel and the bypass tube.

According to another aspect of the present invention, an apparatus for radially expanding and plastically deforming a tubular member is provided that includes a tubular support member defining a longitudinal passage, a tubular outer sleeve coupled to the tubular support member defining a longitudinal passage and a plurality of radial bypass ports, an hydraulic slip coupled to the tubular outer sleeve for controllably engaging the tubular member, one or more packer cups coupled to the tubular outer sleeve for sealingly engaging the tubular member, a tubular inner sleeve positioned within and movably coupled to the tubular outer sleeve defining a longitudinal passage, an annular longitudinal bypass passage, and one or more radial bypass passages, and a tubular expansion cone coupled to the tubular inner sleeve defining a longitudinal passage having a throat passage for receiving a ball, an L-shaped bypass port, and a radial pressure port including an tapered outer expansion surface for radially expanding and plastically deforming the tubular member.

According to another aspect of the present invention, a method of radially expanding and plastically deforming a wellbore casing positioned within a borehole that traverses a subterranean formation is provided that includes positioning an outer tubular sleeve and an inner tubular sleeve comprising an expansion cone within the borehole, wherein the inner tubular sleeve is movably coupled to and at least partially housed within the outer tubular sleeve, injecting a fluidic material into the inner and outer tubular sleeves, coupling the outer tubular sleeve to the wellbore casing, and extending the inner tubular sleeve out of the outer tubular sleeve into the wellbore casing to radially expand and plastically deform a portion of the wellbore casing using the expansion cone.

According to another aspect of the present invention, an apparatus for radially expanding and plastically deforming a wellbore casing positioned within a borehole that traverses a subterranean formation is provided that includes means for positioning an outer tubular sleeve and an inner tubular sleeve comprising an expansion cone within the borehole, wherein the inner tubular sleeve is movably coupled to and at least partially housed within the outer tubular sleeve, means for injecting a fluidic material into the inner and outer tubular sleeves, means for coupling the outer tubular sleeve to the wellbore casing, and means for extending the inner tubular sleeve out of the outer tubular sleeve into the wellbore casing to radially expand and plastically deform a portion of the wellbore casing using the expansion cone.

DETAILED DESCRIPTION OF THE ILLUSTRATIVE EMBODIMENTS

Figure 1:
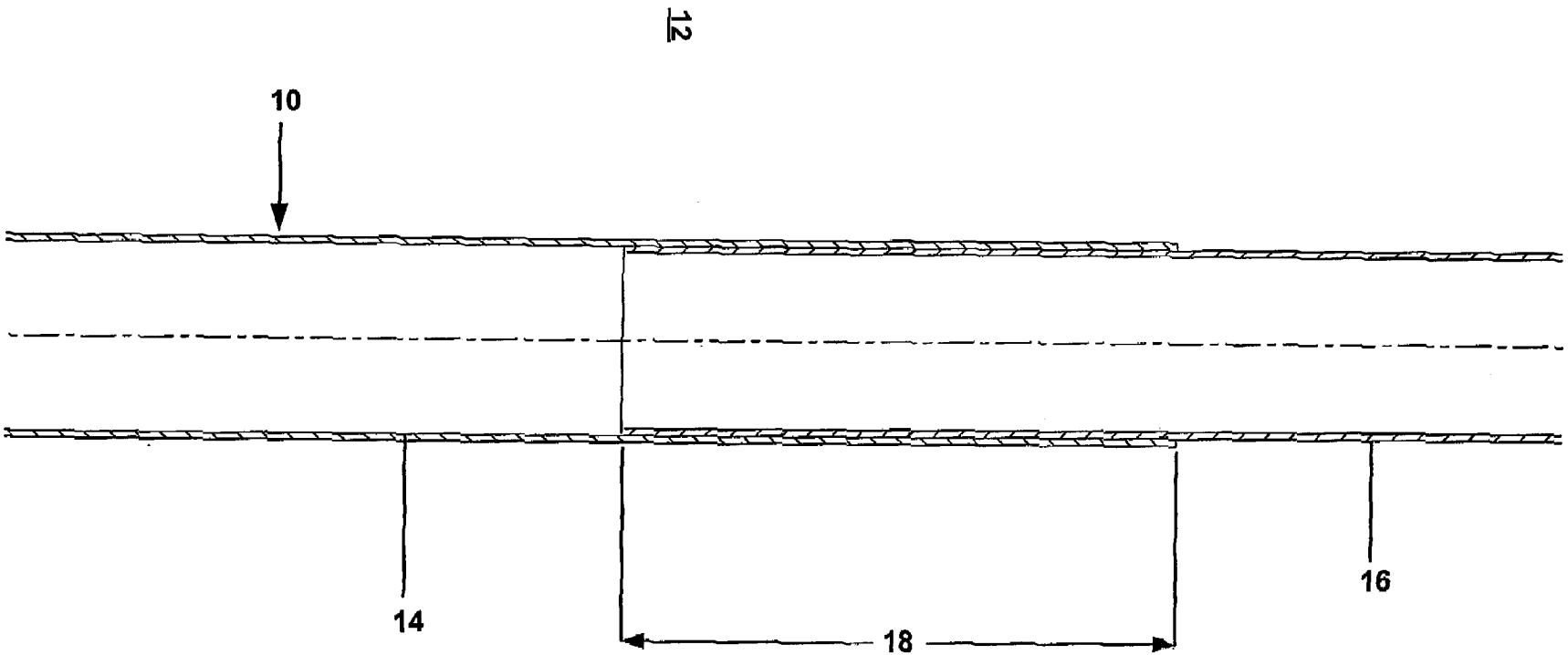
FIG. 1 is a fragmentary cross-sectional illustration of a borehole that traverses a subterranean formation that includes first and second overlapping and radially expanded and plastically deformed wellbore casings.

In an exemplary embodiment, as illustrated in FIG. 1, a borehole 10 that traverses a subterranean formation 12 includes a first wellbore casing 14 and a second wellbore casing 16. The borehole 10 may be positioned in any orientation, for example, from vertical to horizontal. The subterranean formation 12 may include, for example, a source of hydrocarbons and/or geothermal energy. In an exemplary embodiment, the first wellbore casing 14 is positioned within the borehole 10 and radially expanded and plastically deformed. The second wellbore casing 16 is then positioned within the borehole 10 in an overlapping relation to the first wellbore casing 14 and is then radially expanded and plastically deformed. As a result, the upper end of the second wellbore casing 16 is coupled to and positioned within the lower end of the first wellbore casing 14. The overlapping portions 18 of the first and second wellbore casings, 14 and 16, are thereby coupled to one another within the borehole 10.

In several exemplary embodiments, the first and second wellbore casings, 14 and 16, are radially expanded and plastically deformed in an overlapping relationship using one or more of the methods and apparatus disclosed in one or more of the following: (1) U.S. patent application Ser. No. 09/454,139, filed on Dec. 3, 1999, (2) U.S. patent application Ser. No.

09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. patent application Ser. No. 09/969,922, filed on Oct. 3, 2001, (30) U.S. patent application Ser. No. 10/016,467, filed on Dec. 10, 2001; (31) U.S. provisional patent application Ser. No. 60/343,674, filed on Dec. 27, 2001; (32) U.S. provisional patent application Ser. No. 60/346,309, filed on Jan. 7, 2002; (33) U.S. provisional patent application Ser. No. 60/372,048, filed on Apr. 12, 2002; (34) U.S. provisional patent application Ser. No. 60/372,632, filed on Apr. 15, 2002; and (35) U.S. provisional patent application Ser. No. 60/380,147, filed on May 6, 2002, the disclosures of which are incorporated herein by reference.

As illustrated in FIGS. 2*a*-2*d*, in an exemplary embodiment, an apparatus 100 for forming a mono diameter wellbore casing is then positioned within the borehole 10 proximate the overlapping portions 18 of the first and second wellbore casing, 14 and 16, that includes a tubular support member 102 that defines a longitudinal passage 102*a*. An end 104*a* of a tubular adaptor 104 that defines a longitudinal passage 104*b* is threadably coupled to an end 102*b* of the tubular support member 102 that includes an external flange 104*c* having an externally recessed portion 104*d* at another end 104*e* that includes an externally tapered end face 104*f*. In an exemplary embodiment, the tubular support member 102 is a drill pipe.

An end 106*a* of a tubular outer sleeve 106 that defines a longitudinal passage 106*b* and a plurality of radial bypass ports 106*c* at another end 106*d* is threadably coupled to the recessed portion 104*d* of the external flange 104*c* of the end 104*e* of the tubular adaptor 104. An end 108*a* of a tubular hydraulic slip body 108 that defines a longitudinal passage 108*b*, a plurality of L-shaped bypass passages 108*c*, and a plurality of radial slip mounting passages 108*d* includes a recessed portion 108*e* that is threadably coupled to the 106*d* of the tubular outer sleeve 106 and a plurality of circumferentially spaced apart lugs 108*f* that are interleaved with the L-shaped bypass passages. Another end 108*g* of the tubular hydraulic slip body 108 includes an internally recessed portion 108*h* that is threadably coupled to an end 110*a* of a tubular packer cup mandrel 110 that defines a longitudinal passage 110*b* and includes a flange 110*c* at another end 110*d* that defines a recessed portion 110*e* and a plurality of radial passages 110*f*, and one or more lugs 110*g*.

Figure 2A:
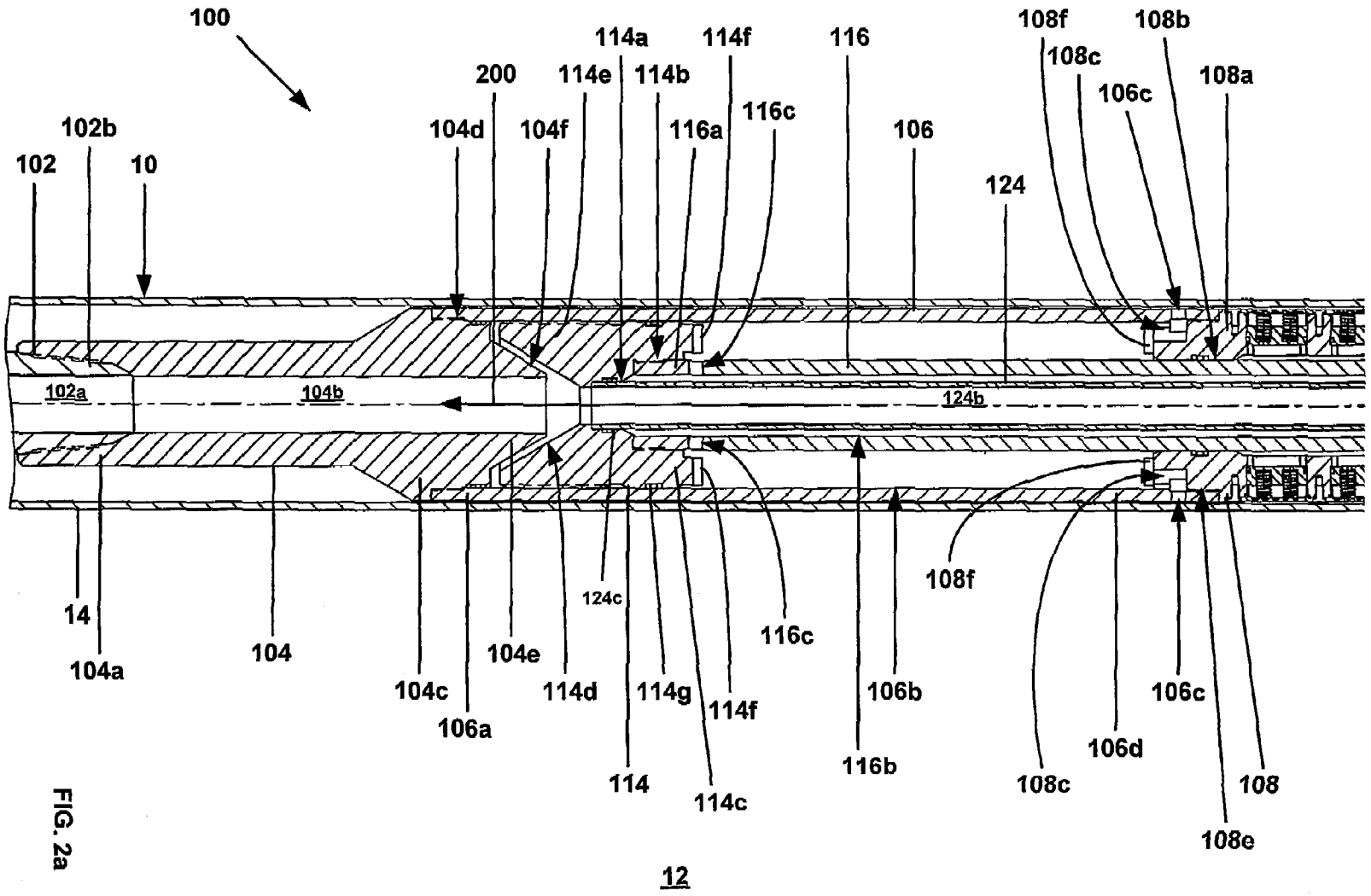
FIGS. 2*a*-2*c* are fragmentary cross-sectional illustrations of the apparatus of FIG. 1 after positioning an apparatus for forming a mono diameter wellbore casing within the borehole proximate the overlapping portions of the first and second wellbore casings.
Figure 2B:
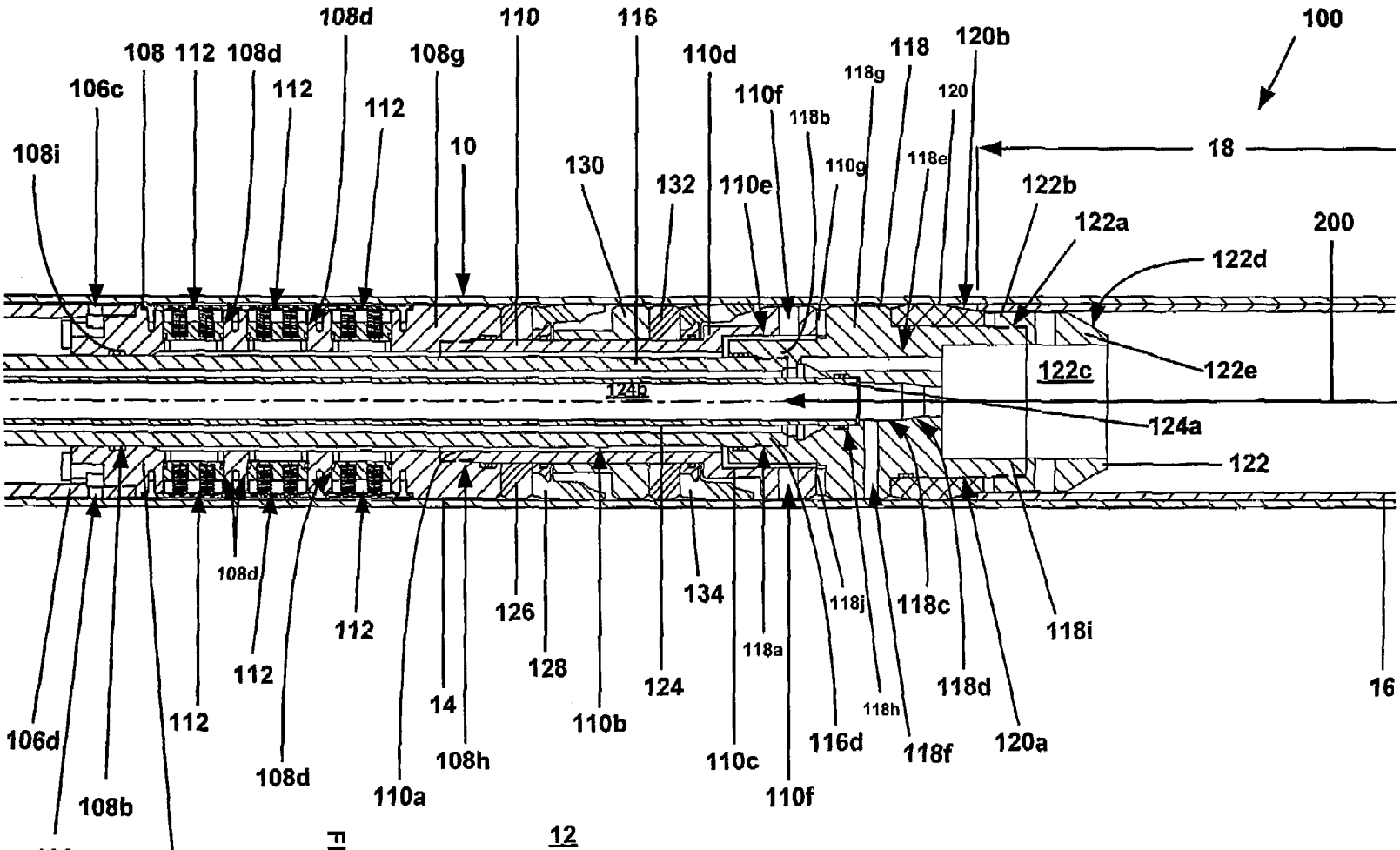
Figure 2C:
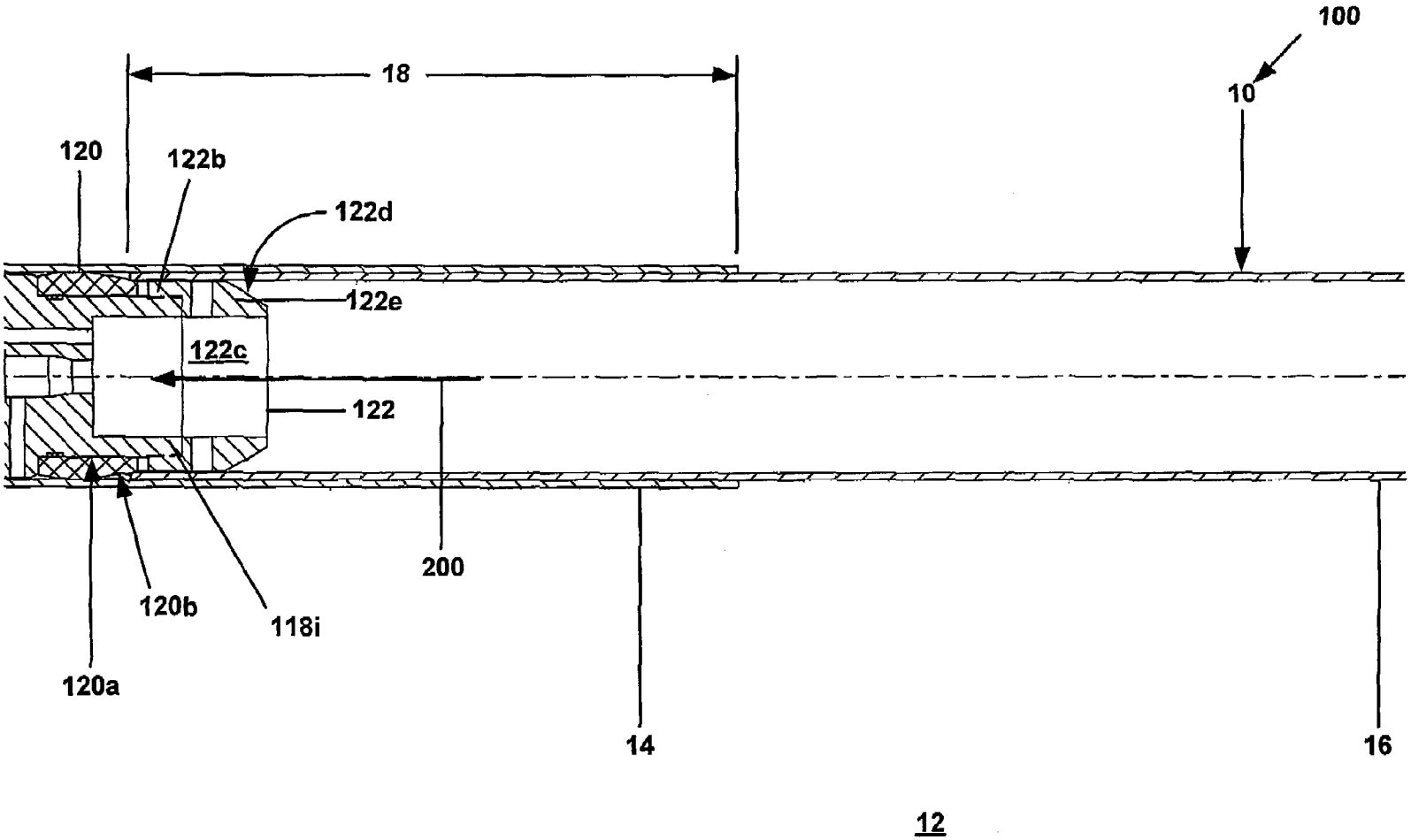
Figure 2D:
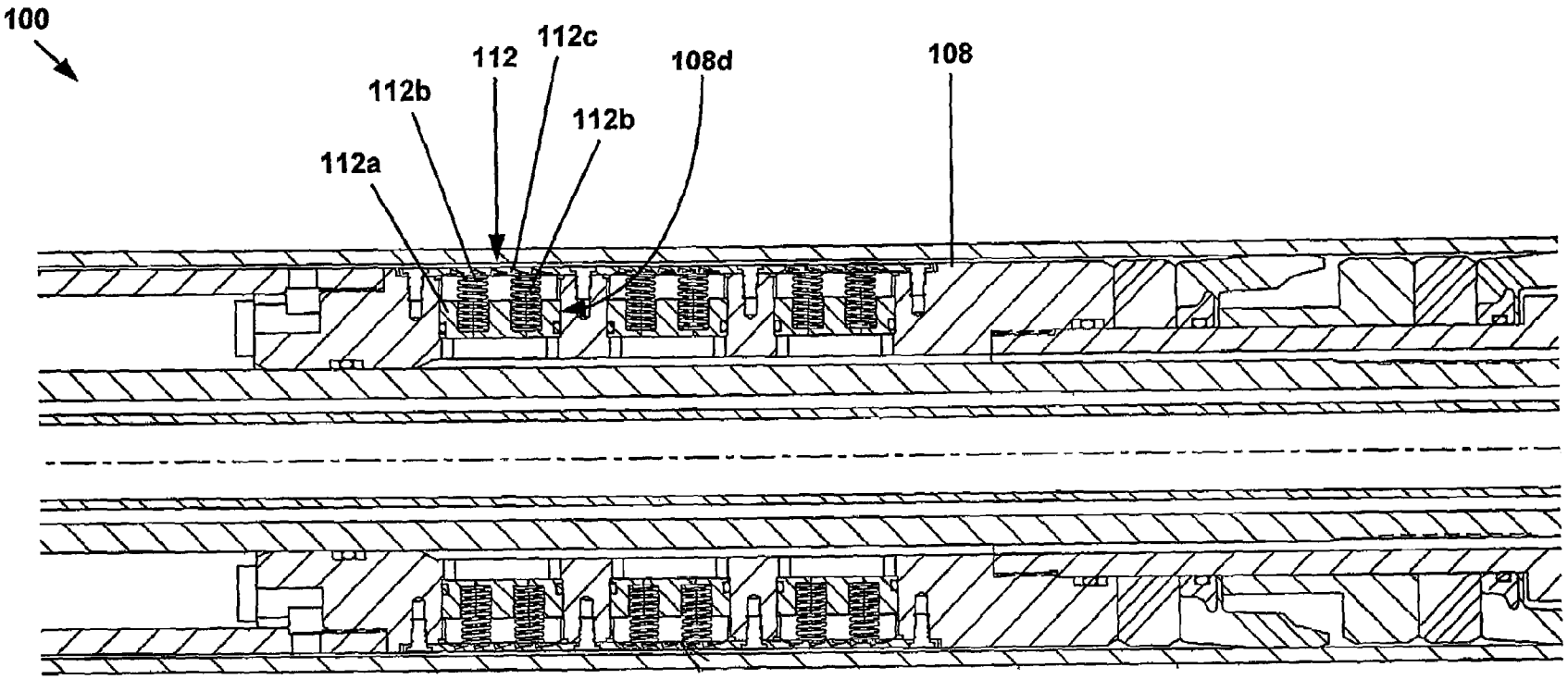
FIG. 2*d* is a fragmentary cross-sectional illustration of one of the hydraulic slips of the apparatus of FIGS. 2*a*-2*c*.

As illustrated in FIG. 2*d*, a plurality of radially movable hydraulic slips 112 are movably coupled to and positioned within corresponding radial slip mounting passages 108*d* of the tubular hydraulic slip body 108 that each include slip base members 112*a*, spring members 112*b*, and slip engaging elements 112*c*. In an exemplary embodiment, the hydraulic slips 112 are round hydraulic slips that are hydraulically actuated when the internal pressure within the hydraulic slip body 108 pushes the hydraulic slips radially outwardly until the hydraulic slips are forced into engagement the internal diameters of the first and/or second wellbore casings, 14 and 16, thereby holding the hydraulic slips and all of the components rigidly attached to the hydraulic slips in place against external loads and pressure. In an exemplary embodiment, when the internal pressure within the hydraulic slip body 108 is reduced, the spring members 112*b* pull the slip engaging elements 112*c* away from the inside diameters of the first and/or second wellbore casings, 14 and 16. In an exemplary embodiment, the lugs 108*f* of the tubular hydraulic slip body 108 may engage the lugs 112*f* on the shoe 114 to allow transmission of torque when apparatus 100 is in extended position. In an exemplary embodiment, the tubular hydraulic slip body 108 also includes internal sealing members 108*i* that provide a fluidic seal between the tubular hydraulic slip body 108 and the inner mandrel 116.

A tubular shoe 114 that defines a longitudinal passage 114*a* and a recessed portion 114*b* at one end 114*c* is received within and mates with the longitudinal passage 106*b* of the tubular outer sleeve 106 that includes an internally tapered end face 114*d* at another end 114*e* and a plurality of circumferentially spaced apart lugs 114*f* at the one end. In an exemplary embodiment, the shoe 114 further includes one or more sealing members 114*g* for fluidicly sealing the interface between the shoe and the tubular outer sleeve 106. An end 116*a* of an inner tubular mandrel 116 that defines a longitudinal passage 116*b* and a plurality of radial bypass ports 116*c* is threadably coupled to the recessed portion 114*b* at the one end 114*c* of the tubular shoe 114 and mates with the longitudinal passage 108*b* of the tubular hydraulic slip body 108. Another end 116*d* of the inner tubular mandrel 116 is threadably coupled to a recessed portion 118*a* of an end 118*b* of an expansion cone mandrel 118 that defines a longitudinal passage 118*c* having a throat passage 118*d*, an L-shaped bypass port 118*e*, and a radial pressure port 118*f*, and includes an external flange 118*g*, another recessed portion 118*h*, and lugs 118*j*.

A tubular expansion cone 120 that defines a longitudinal passage 120*a* mates with and is coupled to another end 118*i* of the expansion cone mandrel 118 proximate the external flange 118*g* that includes an outer expansion surface 120*b* for radially expanding and plastically deforming the first and second wellbore casings, 14 and 16. In an exemplary embodiment, the maximum outside diameter of the outer expansion surface 120*b* of the tubular expansion cone 120 is substantially equal to the inside diameter of the first wellbore casing 14. A recessed portion 122*a* of an end 122*b* of a tubular guide nose 122 that defines a longitudinal passage 122*c* is threadably coupled to the end 118*i* of the expansion cone mandrel 118 that includes a tapered end face 122*d* at another end 122*e*. In an exemplary embodiment, the tubular guide nose 122 helps to guide the apparatus 100 into the first and/or second wellbore casings, 14 and 16.

An end 124*a* of a tubular bypass tube 124 that defines a longitudinal passage 124*b* is received within and coupled to the recessed portion 118*h* of the expansion cone mandrel 118 and another end 124*c* of the tubular bypass tube is received within and coupled to a recess 114*g* in the end 114*c* of the tubular shoe 114. A tubular spacer 126, a first packer cup 128, a second spacer 130, a third spacer 132, and a second packer cup 134 are sequentially mounted on the tubular packer cup mandrel 110 between the end 108*g* of the tubular hydraulic slip body 108 and the end 110*d* of the tubular packer cup mandrel 110. In an exemplary embodiment, the first and second packer cups, 128 and 134, resiliently engage and fluidicly seal the interface with the interior surface of the first wellbore casing 14. In an exemplary embodiment, the packer cups, 128 and 134, provide a fluidic seal between the apparatus 100 and the first and/or second wellbore casings, 14 and 16. In this manner, an annular chamber above the expansion cone 120 within the first and/or second wellbore casings, 14 and 16, may be pressurized for reasons to be described. In an exemplary embodiment, the lugs 110*g* on the end 110*d* of the packer cup mandrel 110 may engage the lugs 118*j* on the end face of the flange 118*g* of the expansion cone mandrel 118 to allow the transmission of torque loads when the apparatus is in a collapsed position.

During the placement of the apparatus 100 within the borehole 10 proximate the overlapping portions 18 of the first and second wellbore casings, 14 and 16, fluidic materials 200 within the borehole are conveyed through the longitudinal passages 122*c*, 118*c*, 124*b*, 104*b*, and 102*a* of the apparatus 100. In this manner, surge pressures within the borehole 10 are minimized during the insertion and placement of the apparatus 100 within the borehole.

As illustrated in FIGS. 2*b* and 2*c*, in an exemplary embodiment, the apparatus 100 is positioned proximate the overlapping portions 18 of the first and second wellbore casings, 14 and 16, with the leading edge of the outer expansion surface 120*b* of the tubular expansion cone 120 positioned within the interior of the upper end of the second wellbore casing 16 and with the guide nose 122 mating with and extending into the interior of the upper end of the second wellbore casing. In this manner, the apparatus 100 is located and supported at least in part by the upper end of the second wellbore casing 16. Furthermore, in this manner, the apparatus 100 is centrally positioned within the first and second wellbore casings, 14 and 16.

Figure 3A:
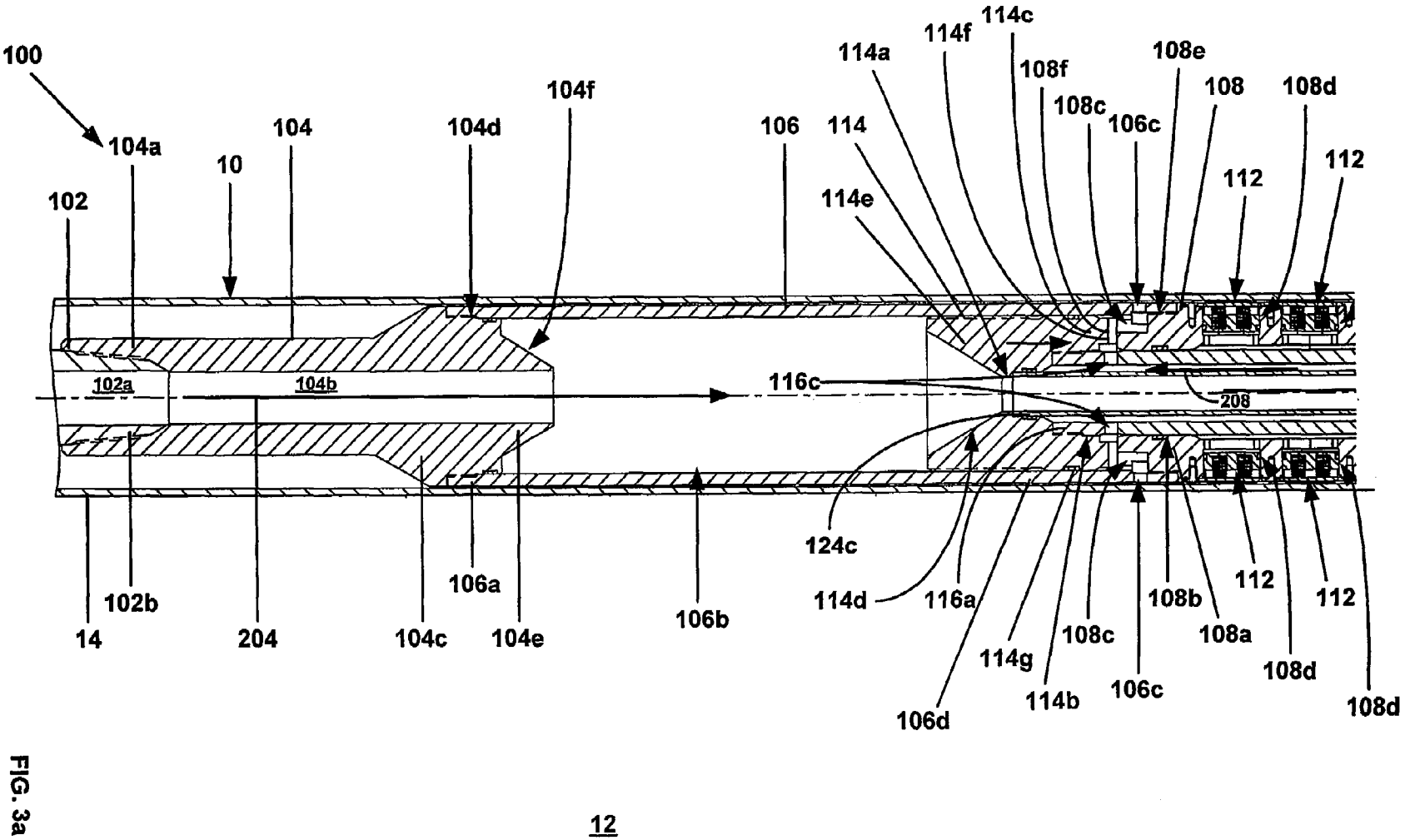
FIGS. 3*a*-3*c* are fragmentary cross-sectional illustrations of the apparatus of FIGS. 2*a*-2*c* after activating the apparatus for forming a mono diameter wellbore casing to thereby radially expand the overlapping portions of the first and second wellbore casings.
Figure 3B:
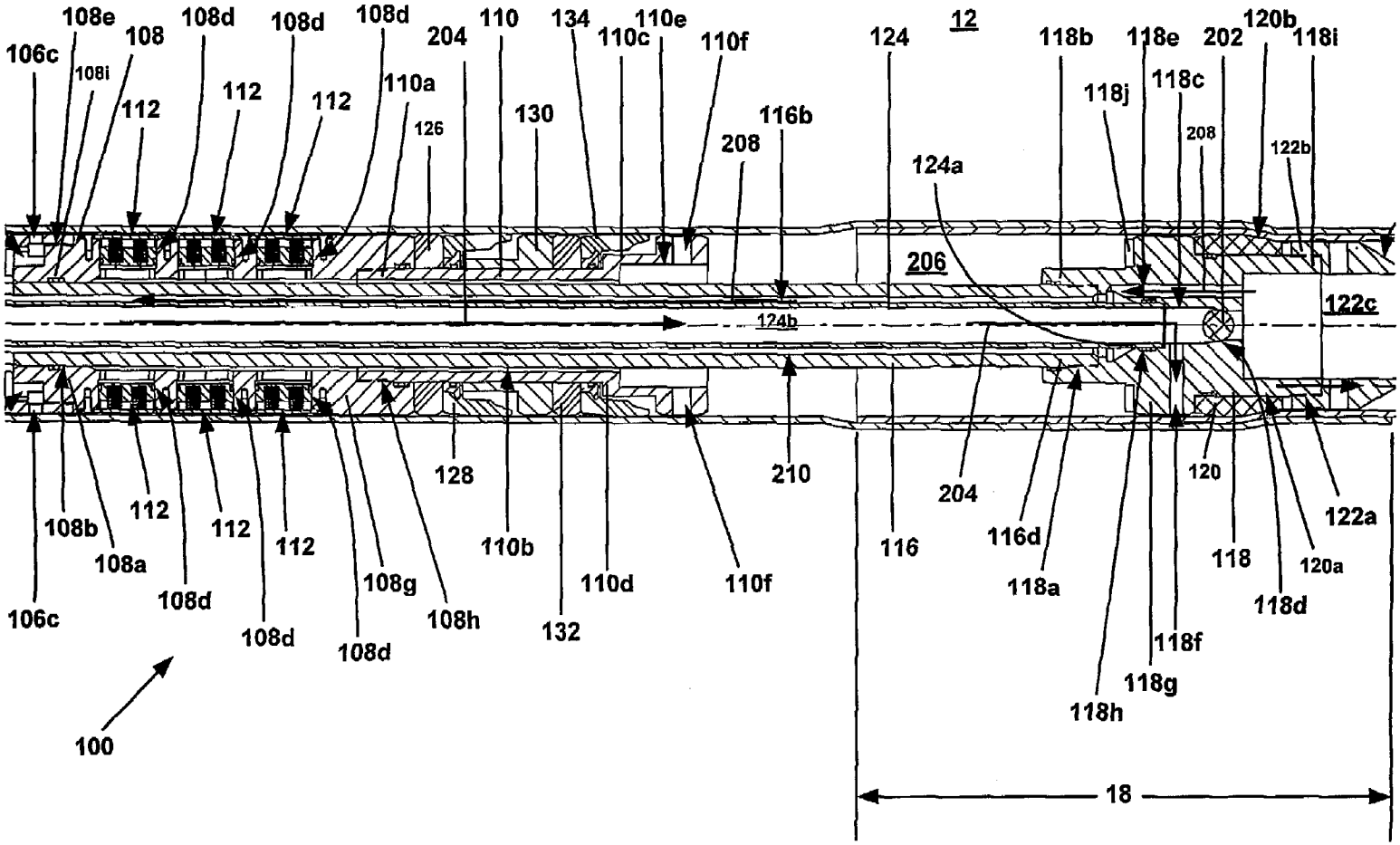
Figure 3C:
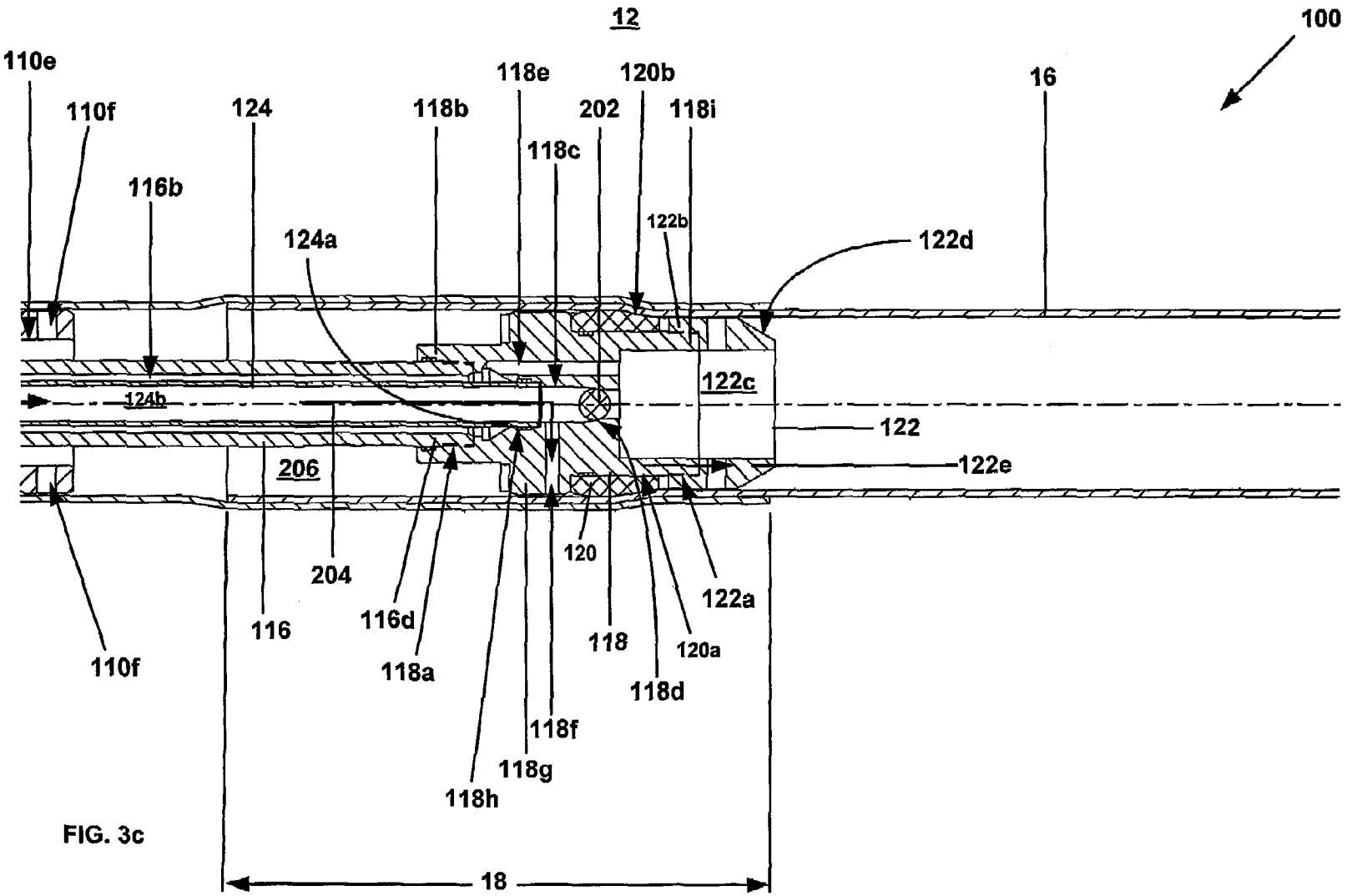

In an exemplary embodiment, as illustrated in FIGS. 3*a*-3*c*, a ball 202 is then positioned within the throat passage 118*d* of the longitudinal passage 118*c* of the expansion cone mandrel 118 by injecting a fluidic material 204 into the apparatus 100 through the longitudinal passages 102*a*, 104*b*, 106*b*, 114*a*, 124*b*, and 118*c*. The injected fluidic material 204 is also conveyed through the radial pressure ports 118*f* of the expansion cone mandrel 118 into an annular chamber 206 above the external flange 118*g* of the expansion cone mandrel and then into the longitudinal passages 110*b* and 108*b* of the packer cup mandrel 110 and hydraulic slip body 108, respectively, and into the radial slip mounting passages 108*d* of the hydraulic slip body. Continued injection of the fluidic material 204 into the apparatus 100 through the longitudinal passages 102*a*, 104*b*, 106*b*, 114*a*, 124*b*, and 118*c* pressurizes the annular chamber 206 and the radial slip mounting passages 108*d* thereby displacing the expansion cone mandrel 118, the expansion cone 120, and the guide nose 122 downwardly in the longitudinal direction and displacing the hydraulic slips 112 outwardly in the radial direction.

In particular, the outward radial displacement of the hydraulic slips 112 causes the hydraulic slips to engage in the interior surface of the first wellbore casing 14 thereby fixing the position of the tubular support member 102, the tubular adaptor 104, the hydraulic slip body 108, the packer cup mandrel 110, the spacer 126, the packer cup 128, the spacer 130, the spacer 132, and the packer cup 134 relative to the first wellbore casing. As a result, the shoe 114, the inner mandrel 116, the expansion cone mandrel 118, the expansion cone 120, the guide nose 122, and the bypass tube 124 are then displaced downwardly relative to the tubular support member 102, the tubular adaptor 104, the hydraulic slip body 108, the packer cup mandrel 110, the spacer 126, the packer cup 128, the spacer 130, the spacer 132, and the packer cup 134 by the pressurization of the annular chamber 206.

The downward longitudinal displacement of the expansion cone 120 radially expands and plastically deforms the overlapping portions 18 of the first and second wellbore casings, 14 and 16. As a result of the radial expansion and plastic deformation, the inside diameter of the portion of the second wellbore casing 16 that overlaps with the first wellbore casing 14 is then substantially equal to the inside diameter of the portion of the first wellbore casing that does not overlap with the second wellbore casing.

During the downward longitudinal displacement of the expansion cone mandrel 118, the expansion cone 120, and the guide nose 122, fluidic materials 208 within the second wellbore casing 16 that are displaced by the downward longitudinal displacement of the expansion cone mandrel, the expansion cone, and the guide nose are conveyed through the bypass port 118*e* of the expansion cone mandrel, the annular bypass passage 210 defined between the inner mandrel 116 and the bypass tube 124, the bypass ports 116*c* of the inner mandrel, the bypass ports 108*c* of the hydraulic slip body 108, and the bypass ports 106*c* of the outer sleeve 106 out of the apparatus 100.

In an exemplary embodiment, during the pressurization of the annular chamber 206, the packer cups 128 and 134 provide a fluidic seal between the apparatus 100 and the first and second wellbore casings, 14 and 16. Furthermore, during the pressurization of the annular chamber 206, the interface between the tubular expansion cone 120 and the first and/or second wellbore casings, 14 and 16, is not fluid tight. In this manner, lubricants that may be provided in the injected fluidic materials 204 may be conveyed to the leading edge of the interface between the expansion surface 120*b* and the first and/or second wellbore casing, 14 and 16, in order to minimize frictional forces and thereby enhance the operation efficiency of the operation.

In an exemplary embodiment, as illustrated in FIG. 3*a*, the shoe 114, the inner mandrel 116, the expansion cone mandrel 118, the expansion cone 120, the guide nose 122, and the bypass tube 124 are then displaced downwardly relative to the tubular support member 102, the tubular adaptor 104, the hydraulic slip body 108, the packer cup mandrel 110, the spacer 126, the packer cup 128, the spacer 130, the spacer 132, and the packer cup 134 by the pressurization of the annular chamber 206 until the lugs 114*f* of the shoe impact the hydraulic slip body 108. At this point, in an exemplary embodiment, the operating pressure within the annular chamber 206 will increase suddenly thereby indicating that the expansion cone 120 has reached the end of the expansion stroke.

Figure 4A:
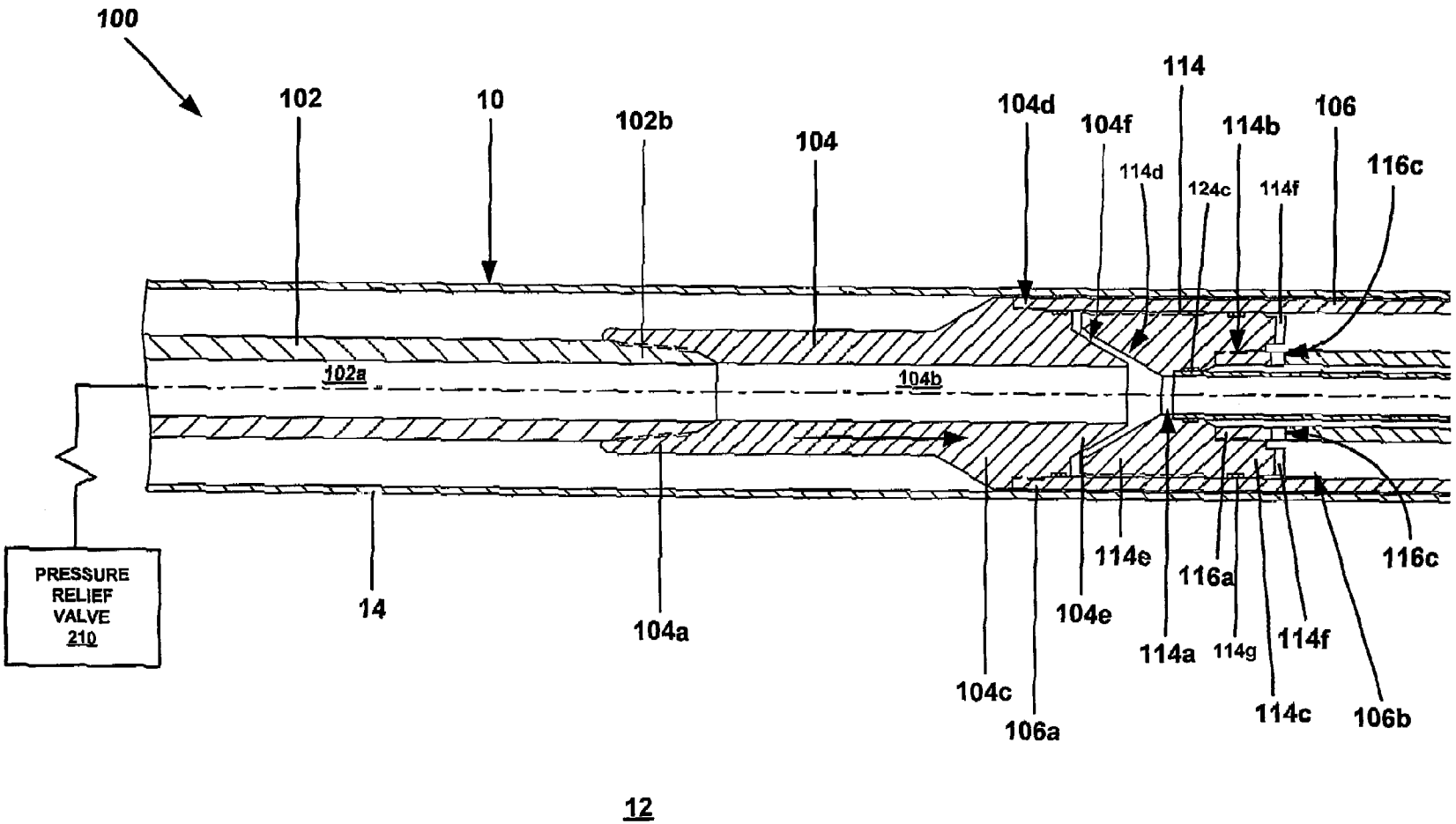
FIGS. 4*a*-4*c* are fragmentary cross-sectional illustrations of the apparatus of FIGS. 3*a*-3*c* after deactivating and repositioning the apparatus for forming a mono diameter wellbore casing proximate another portion of the overlapping portion of the first and second wellbore casings.
Figure 4B:
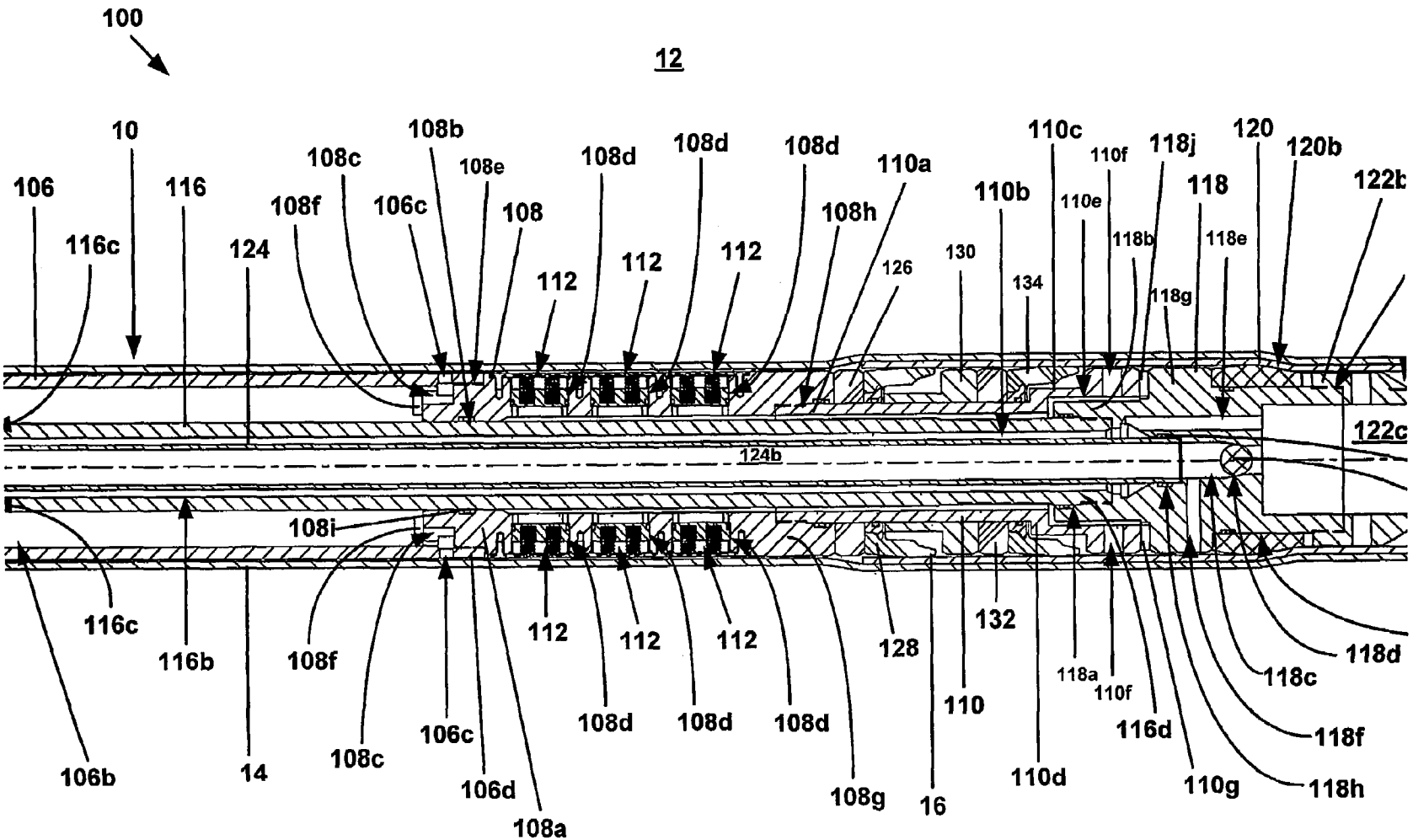
Figure 4C:
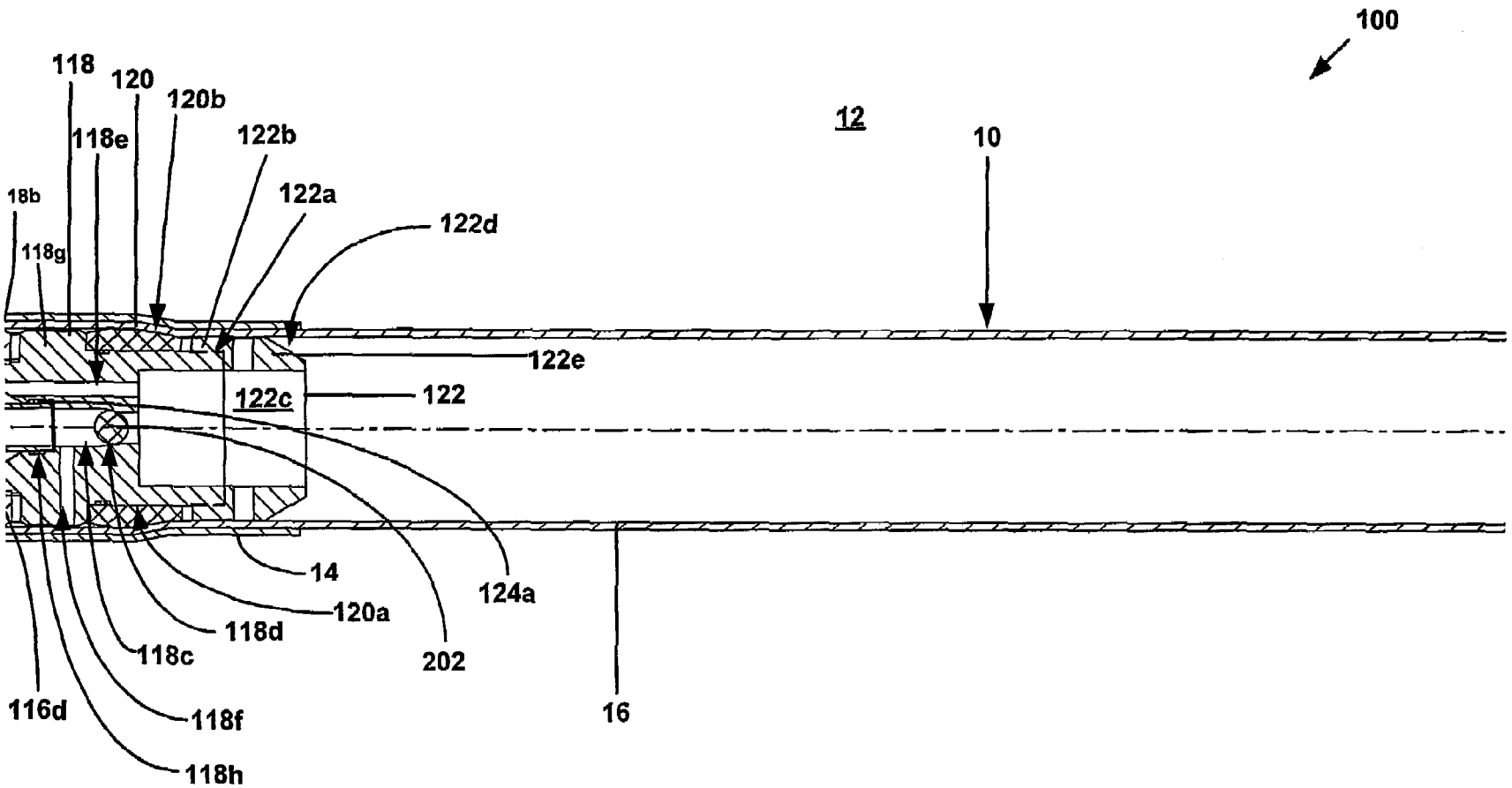

In an exemplary embodiment, as illustrated in FIGS. 4*a*-4*c*, once the expansion cone 120 has reached the end of the expansion stroke, the operating pressures of the annular chamber 206 and the radial slip mounting passages 108*d* are reduced by stopping the injection of the fluidic material 204 into the apparatus 100 and/or by activating one or more pressure relief valves 210 at a surface location to relieve the operating pressures in the annular chamber and radial slip mounting passages to atmospheric. As a result of the pressure relief of the operating pressures of the annular chamber 206 and the radial slip mounting passages 108*d*, the hydraulic slips 112 may be displaced inwardly in the radial direction thereby disengaging the hydraulic slip body 108 from the first wellbore casing 14. Furthermore, as a result of the pressure relief of the operating pressures of the annular chamber 206 and the radial slip mounting passages 108*d*, the support member 102, the adapter 104, the outer sleeve 106, the hydraulic slip body 108, the packer cup mandrel 110, the hydraulic slips 112, the spacer 126, the first packer cup 128, the spacer 130, the spacer 132, and the second packer cup 134 may then be displaced downwardly in the longitudinal direction relative to the shoe 114, the inner mandrel 116, the expansion cone mandrel 118, the expansion cone 120, the guide nose 122, and the bypass tube 124 until the internally tapered end face 114*d* of the shoe 114 impacts the of the external tapered end face 104*f* of the adapter 104. In this manner, the apparatus 100 is placed in a collapsed position.

Figure 5A:
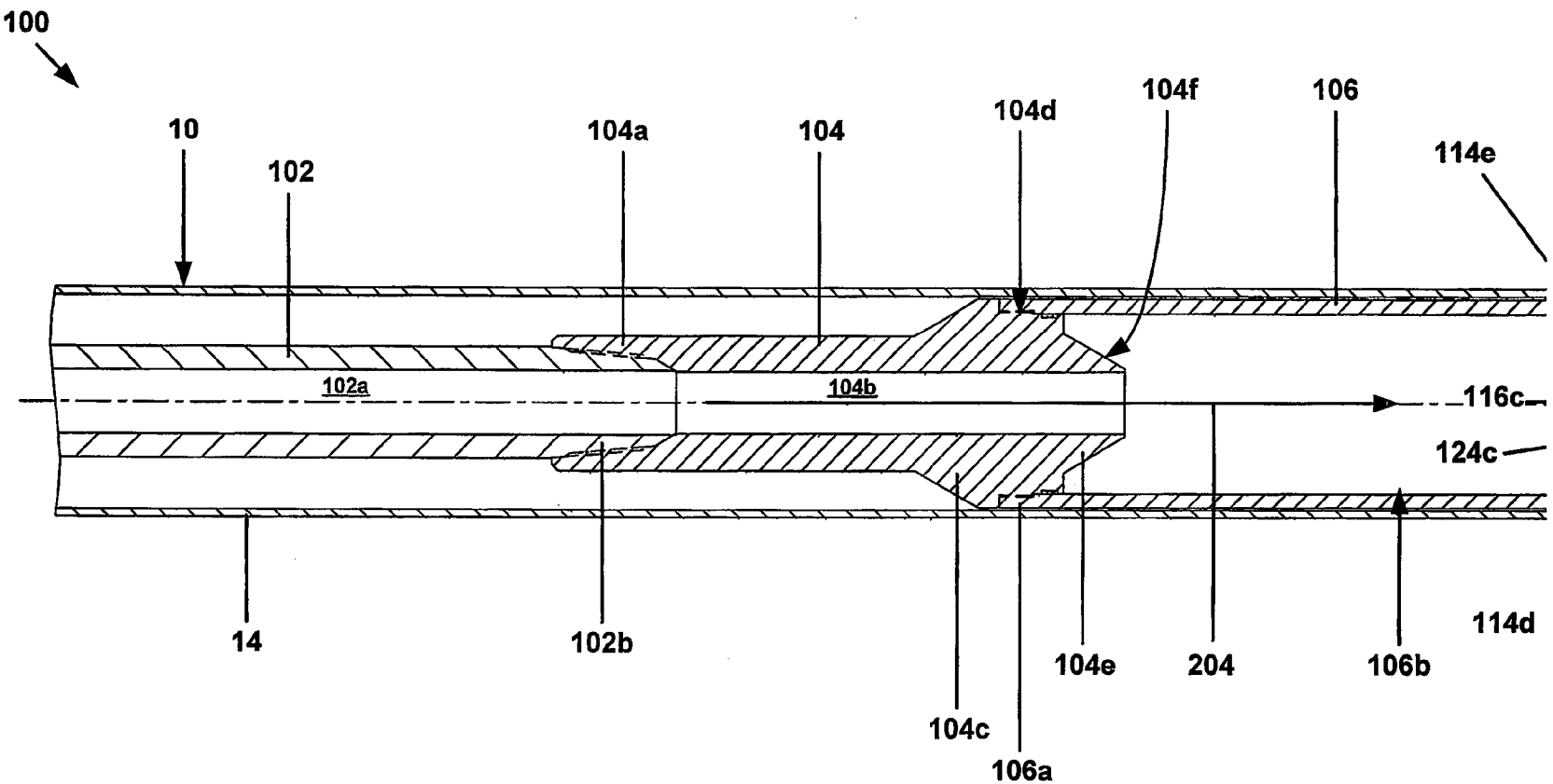
FIG. 5*a*-5*c* are fragmentary cross sectional illustrations of the apparatus of FIGS. 4*a*-4*c* after reactivating the apparatus for forming a mono diameter wellbore casing to thereby radially expand the other overlapping portions of the first and second wellbore casings and a non overlapping portion of the second wellbore casing.
Figure 5B:
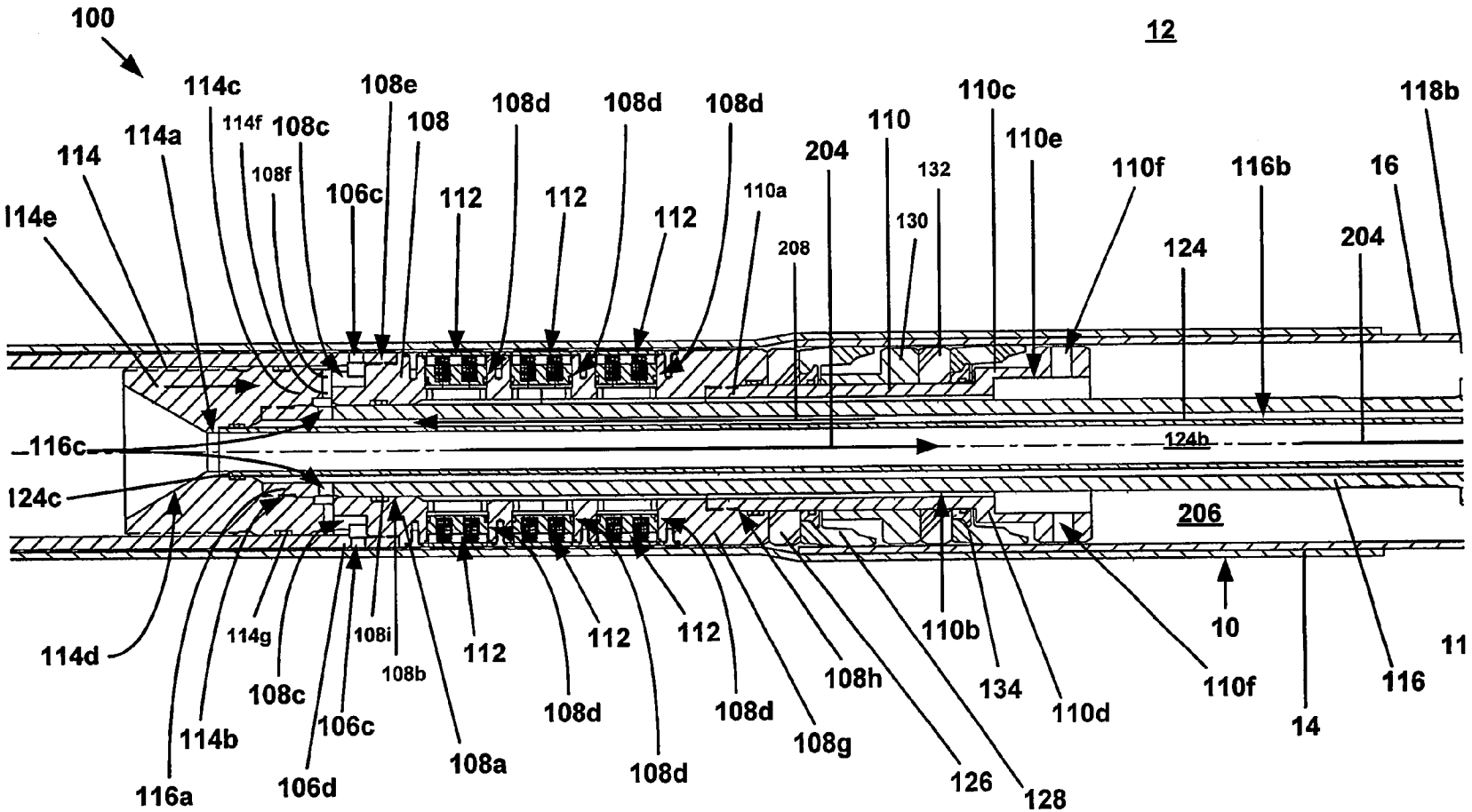
Figure 5C:
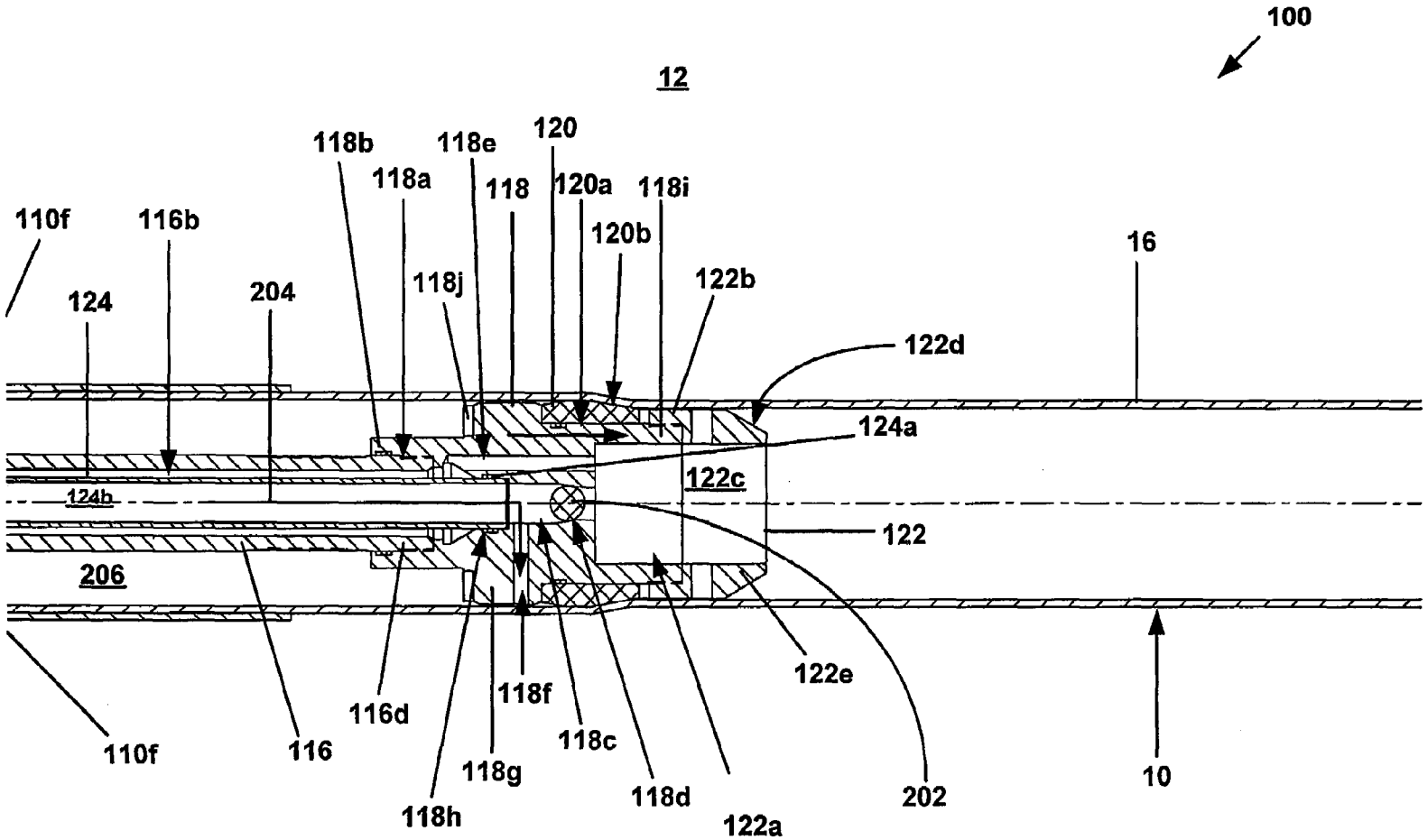

In an exemplary embodiment, as illustrated in FIGS. 5*a*-5*c*, the fluidic material 204 is once again injected into the apparatus 100 through the longitudinal passages 102*a*, 104*b*, 106*b*, 114*a*, 124*b*, and 118*c*. The injected fluidic material 204 is also conveyed through the radial pressure ports 118*f* of the expansion cone mandrel 118 into an annular chamber 206 above the external flange 118*g* of the expansion cone mandrel and then into the longitudinal passages 110*b* and 108*b* of the packer cup mandrel 110 and hydraulic slip body 108, respectively, and into the radial slip mounting passages 108*d* of the hydraulic slip body. Continued injection of the fluidic material 204 into the apparatus 100 through the longitudinal passages 102*a*, 104*b*, 106*b*, 114*a*, 124*b*, and 118*c* pressurizes the annular chamber 206 and the radial slip mounting passages 108*d* thereby displacing the expansion cone mandrel 118, the expansion cone 120, and the guide nose 122 downwardly in the longitudinal direction and displacing the hydraulic slips 112 outwardly in the radial direction.

In particular, the outward radial displacement of the hydraulic slips 112 causes the hydraulic slips to engage in the interior surface of the first wellbore casing 14 thereby fixing the position of the tubular support member 102, the tubular adaptor 104, the hydraulic slip body 108, the packer cup mandrel 110, the spacer 126, the packer cup 128, the spacer 130, the spacer 132, and the packer cup 134 relative to the first wellbore casing. As a result, the shoe 114, the inner mandrel 116, the expansion cone mandrel 118, the expansion cone 120, the guide nose 122, and the bypass tube 124 are then displaced downwardly relative to the tubular support member 102, the tubular adaptor 104, the hydraulic slip body 108, the packer cup mandrel 110, the spacer 126, the packer cup 128, the spacer 130, the spacer 132, and the packer cup 134 by the pressurization of the annular chamber 206.

The downward longitudinal displacement of the expansion cone 120 radially expands and plastically deforms the remaining portion of the overlapping portions 18 of the first and second wellbore casings, 14 and 16, and a non-overlapping portion of the second wellbore casing 16. As a result of the radial expansion and plastic deformation, the inside diameter of the portion of the second wellbore casing 16 that overlaps with the first wellbore casing 14 is then substantially equal to the inside diameter of the portion of the first wellbore casing that does not overlap with the second wellbore casing. Furthermore, as a result of the radial expansion and plastic deformation, the inside diameter of at least a portion of the second wellbore casing 16 that does not overlap with the first wellbore casing 14 is substantially equal to the inside diameter of the portion of the first wellbore casing that does not overlap with the second wellbore casing.

During the downward longitudinal displacement of the expansion cone mandrel 118, the expansion cone 120, and the guide nose 122, fluidic materials 208 within the second wellbore casing 16 that are displaced by the downward longitudinal displacement of the expansion cone mandrel, the expansion cone, and the guide nose are conveyed through the bypass port 118*e* of the expansion cone mandrel, the annular passage 210 defined between the inner mandrel 116 and the bypass tube 124, the bypass ports 116*c* of the inner mandrel, the bypass ports 108*c* of the hydraulic slip body 108, and the bypass ports 106*c* of the outer sleeve 106 out of the apparatus 100.

In an exemplary embodiment, during the pressurization of the annular chamber 206, the packer cups 128 and 134 provide a fluidic seal between the apparatus 100 and the first and second wellbore casings, 14 and 16. Furthermore, during the pressurization of the annular chamber 206, the interface between the tubular expansion cone 120 and the first and/or second wellbore casings, 14 and 16, is not fluid tight. In this manner, lubricants that may be provided in the injected fluidic materials 204 may be conveyed to the leading edge of the interface between the expansion surface 120*b* and the first and/or second wellbore casing, 14 and 16, in order to minimize frictional forces and thereby enhance the operation efficiency of the operation.

In an exemplary embodiment, as illustrated in FIG. 5*b*, the shoe 114, the inner mandrel 116, the expansion cone mandrel 118, the expansion cone 120, the guide nose 122, and the bypass tube 124 are then displaced downwardly relative to the tubular support member 102, the tubular adaptor 104, the hydraulic slip body 108, the packer cup mandrel 110, the spacer 126, the packer cup 128, the spacer 130, the spacer 132, and the packer cup 134 by the pressurization of the annular chamber 206 until the lugs 114*f* of the shoe impact the hydraulic slip body 108. At this point, in an exemplary embodiment, the operating pressure within the annular chamber 206 will increase suddenly thereby indicating that the expansion cone 120 has reached the end of the expansion stroke.

Figure 6:
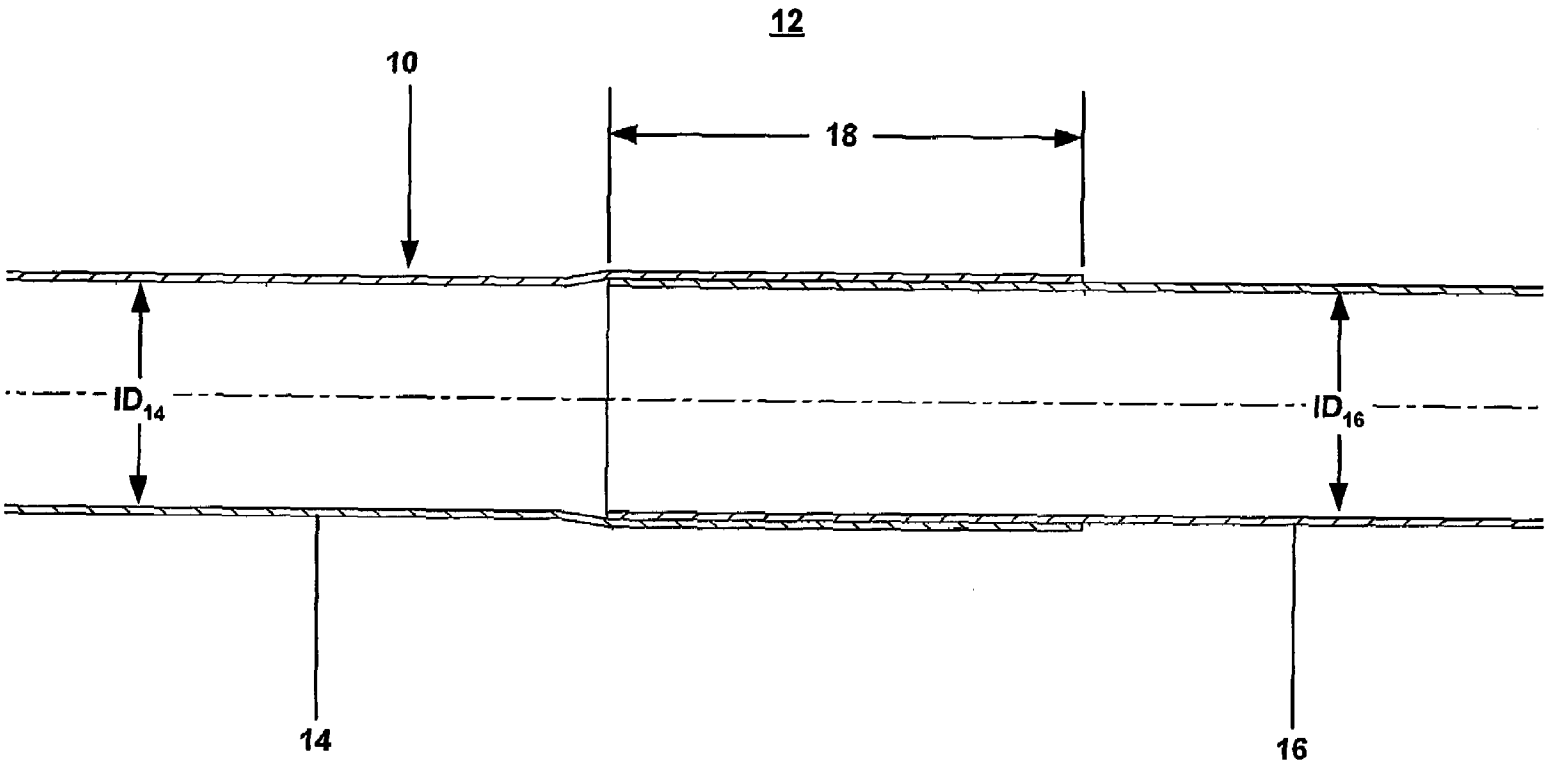
FIG. 6 is a fragmentary cross-sectional illustration of the apparatus of FIGS. 5*a*-5*c* after forming a mono diameter wellbore casing that includes the first and second wellbore casings.

As illustrated in FIG. 6, in an exemplary embodiment, the operations of FIGS. 3*a*-3*c*, 4*a*-4*c*, and 5*a*-5*c*, may then be repeated to thereby radially expand and plastically deform the remaining portions of the second wellbore casing 16 that do not overlap with the first wellbore casing 14. As a result, a mono diameter wellbore casing is constructed that includes the first and second wellbore casings, 14 and 16. The inside diameter of the first wellbore casing $ID_{14}$ is substantially equal to the inside diameter of the second wellbore casing $ID_{16}$.

The illustrative embodiments provide the advantage of expanding the casing without applying pressure to the entire casing string and allowing easy retrieval of the expansion apparatus 100 if expansion problems develop.

In several alternative embodiments, the expansion cone 120 may be an expandable adjustable expansion cone.

In several alternative embodiments, other sealing methods and apparatus between the apparatus 100 and the inside diameters of the first and/or second wellbore casings, 14 and 16, may be used. For example, hydraulically and/or mechanically actuated packer elements and/or mechanical slips with drag blocks and J-slots may be used in place of the hydraulic slips 112 to hold the tubular hydraulic slip body 108 in a stationary position during the radial expansion process.

In several alternative embodiments, the apparatus 100 can also be used for single stage top-down expansion of cased and open hole liners and as a liner hanger. In an exemplary embodiment, the expansion cone 120, the packer cups, 128 and 134, and the hydraulic slips 112 are run in an expansion cone launcher as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. patent application Ser. No. 09/969,922, filed on Oct. 3, 2001, (30) U.S. patent application Ser. No. 10/016,467, filed on Dec. 10, 2001; (31) U.S. provisional patent application Ser. No. 60/343,674, filed on Dec. 27, 2001; (32) U.S. provisional patent application Ser. No. 60/346,309, filed on Jan. 7, 2002; (33) U.S. provisional patent application Ser. No. 60/372,048, filed on Apr. 12, 2002; (34) U.S. provisional patent application Ser. No. 60/372,632, filed on Apr. 15, 2002; and (35) U.S. provisional patent application Ser. No. 60/380,147, filed on May 6, 2002, the disclosures of which are incorporated herein by reference.

The first stroke of the expansion cone 120 expands the expandable casing out to contact the well casing with enough force to hold the weight of the expandable casing string or liner. Pressure is then released and the expansion assy is moved down to the collapsed position and the expansion process repeated.

A method of forming a mono diameter wellbore casing within a borehole that traverses a subterranean formation has been described that includes positioning a first wellbore casing within the borehole, radially expanding and plastically deforming the first wellbore casing within the borehole, positioning a second wellbore casing within the borehole in overlapping relation to the first wellbore casing, radially expanding and plastically deforming the second wellbore casing within the borehole, radially expanding and plastically deforming the overlapping portions of the first and second wellbore casings, and radially expanding and plastically deforming at least a portion of the second wellbore casing that does not overlap with the first wellbore casing. The inside diameter of the portion of the first wellbore casing that does not overlap with the second wellbore casing is substantially equal to the inside diameter of the radially expanded and plastically deformed portions of the second wellbore casing. In an exemplary embodiment, the radially expanding and plastically deforming the overlapping portions of the first and second wellbore casings includes positioning a telescoping radial expansion device comprising an outer sleeve and an inner sleeve positioned within and movably coupled to the outer sleeve comprising a tubular expansion cone proximate the end of the second wellbore casing, and injecting a fluidic material into the telescoping radial expansion device to cause the outer sleeve to engage the first wellbore casing and cause the inner sleeve to extend out of the outer sleeve into the overlapping portions of the first and second wellbore casings to cause the tubular expansion cone to radially expand and plastically deform the overlapping portions of the first and second wellbore casings. In an exemplary embodiment, the method further includes conveying fluidic materials within the borehole that are displaced by the extension of the inner sleeve to a location within the borehole above the tubular expansion cone. In an exemplary embodiment, radially expanding and plastically deforming at least a portion of the second wellbore casing that does not overlap with the first wellbore casing includes reducing the operating pressure within the telescoping radial expansion device, moving the outer sleeve onto the inner sleeve of the telescoping radial expansion device, and injecting a fluidic material into the telescoping radial expansion device to cause the outer sleeve to engage at least one of the first and second wellbore casings and cause the inner sleeve to extend out of the outer sleeve into the second wellbore casing to cause the tubular expansion cone to radially expand and plastically deform at least a portion of the second wellbore casing. In an exemplary embodiment, the method further includes conveying fluidic materials within the borehole that are displaced by the extension of the inner sleeve to a location within the borehole above the tubular expansion cone.

An apparatus for forming a mono diameter wellbore casing has been described that includes means for positioning a first wellbore casing within the borehole, means for radially expanding and plastically deforming the first wellbore casing within the borehole, means for positioning a second wellbore casing within the borehole in overlapping relation to the first wellbore casing, means for radially expanding and plastically deforming the second wellbore casing within the borehole, means for radially expanding and plastically deforming the overlapping portions of the first and second wellbore casings, and means for radially expanding and plastically deforming at least a portion of the second wellbore casing that does not overlap with the first wellbore casing. The inside diameter of the portion of the first wellbore casing that does not overlap with the second wellbore casing is substantially equal to the inside diameter of the radially expanded and plastically deformed portions of the second wellbore casing. In an exemplary embodiment, the means for radially expanding and plastically deforming the overlapping portions of the first and second wellbore casings includes means for positioning a telescoping radial expansion device comprising an outer sleeve and an inner sleeve positioned within and movably coupled to the outer sleeve comprising a tubular expansion cone proximate the end of the second wellbore casing, and means for injecting a fluidic material into the telescoping radial expansion device to cause the outer sleeve to engage the first wellbore casing and cause the inner sleeve to extend out of the outer sleeve into the overlapping portions of the first and second wellbore casings to cause the tubular expansion cone to radially expand and plastically deform the overlapping portions of the first and second wellbore casings. In an exemplary embodiment, the method further includes conveying fluidic materials within the borehole that are displaced by the extension of the inner sleeve to a location within the borehole above the tubular expansion cone. In an exemplary embodiment, the means for radially expanding and plastically deforming at least a portion of the second wellbore casing that does not overlap with the first wellbore casing includes means for reducing the operating pressure within the telescoping radial expansion device, means for moving the outer sleeve onto the inner sleeve of the telescoping radial expansion device, and means for injecting a fluidic material into the telescoping radial expansion device to cause the outer sleeve to engage at least one of the first and second wellbore casings and cause the inner sleeve to extend out of the outer sleeve into the second wellbore casing to cause the tubular expansion cone to radially expand and plastically deform at least a portion of the second wellbore casing. In an exemplary embodiment, the method further includes conveying fluidic materials within the borehole that are displaced by the extension of the inner sleeve to a location within the borehole above the tubular expansion cone.

An apparatus for radially expanding and plastically deforming a tubular member has been described that includes a tubular adapter defining a longitudinal passage, a tubular outer sleeve coupled to the tubular adapter defining a longitudinal passage, a tubular hydraulic slip body coupled to the tubular outer sleeve defining a plurality of L-shaped bypass ports and a plurality of radial hydraulic slip mounting passages, a plurality of hydraulic slips movably coupled and positioned within corresponding radial hydraulic slip mounting passages for engaging the tubular member, a tubular packer cup mandrel coupled to the tubular hydraulic slip body defining a longitudinal passage, a plurality of packer cups coupled to the tubular packer cup mandrel for sealingly engaging the tubular member, a tubular shoe positioned within and movably coupled to the tubular outer sleeve defining a longitudinal passage, a tubular inner mandrel positioned within and movably coupled to the tubular hydraulic slip body coupled to the tubular shoe defining a longitudinal passage and a plurality of radial bypass ports, a tubular expansion cone mandrel coupled to the tubular inner mandrel defining a longitudinal passage having a throat passage for receiving a ball, an L-shaped bypass port, and a radial pressure port, a tubular expansion cone coupled to the tubular expansion cone including a tapered outer expansion surface for radially expanding and plastically deforming the tubular member, a tubular guide nose coupled to the tubular expansion cone mandrel defining a longitudinal passage, a bypass tube positioned within the tubular inner mandrel coupled to the expansion cone mandrel and the tubular shoe defining a longitudinal passage, and an annular longitudinal bypass passage defied between the tubular inner mandrel and the bypass tube. In an exemplary embodiment, the longitudinal passages of the tubular adapter, bypass tube, and tubular expansion cone mandrel are fluidicly coupled. In an exemplary embodiment, the longitudinal passage of the tubular expansion cone mandrel is fluidicly coupled to the radial pressure port of the tubular expansion cone mandrel. In an exemplary embodiment, the L-shaped bypass port of the tubular expansion cone mandrel is fluidicly coupled to the annular longitudinal bypass passage, the radial bypass passages of the tubular inner mandrel, the L-shaped bypass ports of the tubular hydraulic slip body, and the radial bypass ports of the tubular outer sleeve.

An apparatus for radially expanding and plastically deforming a tubular member has been described that includes a tubular support member defining a longitudinal passage, a tubular outer sleeve coupled to the tubular support member defining a longitudinal passage and a plurality of radial bypass ports, an hydraulic slip coupled to the tubular outer sleeve for controllably engaging the tubular member, one or more packer cups coupled to the tubular outer sleeve for sealingly engaging the tubular member, a tubular inner sleeve positioned within and movably coupled to the tubular outer sleeve defining a longitudinal passage, an annular longitudinal bypass passage, and one or more radial bypass passages, and a tubular expansion cone coupled to the tubular inner sleeve defining a longitudinal passage having a throat passage for receiving a ball, an L-shaped bypass port, and a radial pressure port including an tapered outer expansion surface for radially expanding and plastically deforming the tubular member. In an exemplary embodiment, the longitudinal passages of the tubular outer sleeve and the tubular expansion cone are fluidicly coupled. In an exemplary embodiment, the longitudinal passage of the tubular expansion cone is fluidicly coupled to the radial pressure port of the tubular expansion cone. In an exemplary embodiment, the L-shaped bypass port of the tubular expansion cone is fluidicly coupled to the annular longitudinal bypass passage and the radial bypass passages of the tubular inner sleeve, and the L-shaped bypass ports and the radial bypass ports of the tubular outer sleeve.

A method of radially expanding and plastically deforming a wellbore casing positioned within a borehole that traverses a subterranean formation has been described that includes positioning an outer tubular sleeve and an inner tubular sleeve comprising an expansion cone within the borehole, wherein the inner tubular sleeve is movably coupled to and at least partially housed within the outer tubular sleeve, injecting a fluidic material into the inner and outer tubular sleeves, coupling the outer tubular sleeve to the wellbore casing, and extending the inner tubular sleeve out of the outer tubular sleeve into the wellbore casing to radially expand and plastically deform a portion of the wellbore casing using the expansion cone. In an exemplary embodiment, injecting a fluidic material into the inner and outer tubular sleeves includes injecting the fluidic material into an annular chamber above the expansion cone. In an exemplary embodiment, the method further includes conveying fluidic materials within the borehole displaced by the extension of the inner tubular sleeve to a location above the expansion cone. In an exemplary embodiment, conveying fluidic materials within the borehole displaced by the extension of the inner tubular sleeve above the expansion cone includes conveying fluidic materials within the borehole displaced by the extension of the inner tubular sleeve through an annular passage and one or more radial passages to the location above the expansion cone. In an exemplary embodiment, the method further includes depressuring the inner and outer tubular sleeves, decoupling the outer tubular sleeve and the wellbore casing, and collapsing the outer tubular sleeve onto the inner tubular sleeve. In an exemplary embodiment, the method further includes injecting a fluidic material into the inner and outer tubular sleeves, coupling the outer tubular sleeve to the wellbore casing, and extending the inner tubular sleeve out of the outer tubular sleeve into the wellbore casing to radially expand and plastically deform another portion of the wellbore casing. In an exemplary embodiment, injecting a fluidic material into the inner and outer tubular sleeves includes injecting the fluidic material into an annular chamber above the expansion cone. In an exemplary embodiment, the method further includes conveying fluidic materials within the borehole displaced by the extension of the inner tubular sleeve to a location above the expansion cone. In an exemplary embodiment, conveying fluidic materials within the borehole displaced by the extension of the inner tubular sleeve above the expansion cone includes conveying fluidic materials within the borehole displaced by the extension of the inner tubular sleeve through an annular passage and one or more radial passages to the location above the expansion cone.

An apparatus for radially expanding and plastically deforming a wellbore casing positioned within a borehole that traverses a subterranean formation has been described that includes means for positioning an outer tubular sleeve and an inner tubular sleeve comprising an expansion cone within the borehole, wherein the inner tubular sleeve is movably coupled to and at least partially housed within the outer tubular sleeve, means for injecting a fluidic material into the inner and outer tubular sleeves, means for coupling the outer tubular sleeve to the wellbore casing, and means for extending the inner tubular sleeve out of the outer tubular sleeve into the wellbore casing to radially expand and plastically deform a portion of the wellbore casing using the expansion cone. In an exemplary embodiment, the means for injecting a fluidic material into the inner and outer tubular sleeves includes means for injecting the fluidic material into an annular chamber above the expansion cone. In an exemplary embodiment, the apparatus further includes means for conveying fluidic materials within the borehole displaced by the extension of the inner tubular sleeve to a location above the expansion cone. In an exemplary embodiment, the means for conveying fluidic materials within the borehole displaced by the extension of the inner tubular sleeve above the expansion cone includes means for conveying fluidic materials within the borehole displaced by the extension of the inner tubular sleeve through an annular passage and one or more radial passages to the location above the expansion cone. In an exemplary embodiment, the apparatus further includes means for depressuring the inner and outer tubular sleeves, means for decoupling the outer tubular sleeve and the wellbore casing, and means for collapsing the outer tubular sleeve onto the inner tubular sleeve. In an exemplary embodiment, the apparatus further includes means for injecting a fluidic material into the inner and outer tubular sleeves, means for coupling the outer tubular sleeve to the wellbore casing, means for extending the inner tubular sleeve out of the outer tubular sleeve into the wellbore casing to radially expand and plastically deform another portion of the wellbore casing. In an exemplary embodiment, the means for injecting a fluidic material into the inner and outer tubular sleeves includes means for injecting the fluidic material into an annular chamber above the expansion cone. In an exemplary embodiment, the apparatus further includes means for conveying fluidic materials within the borehole displaced by the extension of the inner tubular sleeve to a location above the expansion cone. In an exemplary embodiment, the means for conveying fluidic materials within the borehole displaced by the extension of the inner tubular sleeve above the expansion cone includes means for conveying fluidic materials within the borehole displaced by the extension of the inner tubular sleeve through an annular passage and one or more radial passages to the location above the expansion cone.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of forming a mono diameter wellbore casing within a borehole that traverses a subterranean formation, comprising:

positioning a first wellbore casing within the borehole;

radially expanding and plastically deforming the first wellbore casing within the borehole;

positioning a second wellbore casing within the borehole in overlapping relation to the first wellbore casing;

radially expanding and plastically deforrning the second wellbore casing within the borehole so that the second wellbore casing comprises a first configuration in which the inside diameter of the overlapping portion of the second wellbore casing is less than the inside diameter of the portion of the first wellbore casing that does not overlap with the second wellbore casing;

radially expanding and plastically deforming the overlapping portions of the first and second wellbore casings; and radially expanding and plastically deforming at least a portion of the second wellbore casing that does not overlap with the first wellbore casing so that the second wellbore casing comprises a second configuration in which the inside diameter of the overlapping portion and the at least a portion of the second wellbore casing is egual to the inside diameter of the portion of the first wellbore casing that does not overlap with the second wellbore casing.

2. The method of claim 1, wherein radially expanding and plastically deforming the overlapping portions of the first and second wellbore casings comprises:

positioning a telescoping radial expansion device comprising an outer sleeve and an inner sleeve positioned within and movably coupled to the outer sleeve comprising a tubular expansion cone proximate the end of the second wellbore casing; and injecting a fluidic material into the telescoping radial expansion device to cause the outer sleeve to engage the first wellbore casing and cause the inner sleeve to extend out of the outer sleeve into the overlapping portions of the first and second wellbore casings to cause the tubular expansion cone to radially expand and plastically deform the overlapping portions of the first and second wellbore casings.

3. The method of claim 2, further comprising:

conveying fluidic materials within the borehole that are displaced by the extension of the inner sleeve to a location within the borehole above the tubular expansion cone.

4. The method of claim 2, wherein radially expanding and plastically deforming at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

reducing the operating pressure within the telescoping radial expansion device;

moving the outer sleeve onto the inner sleeve of the telescoping radial expansion device; and injecting a fluidic material into the telescoping radial expansion device to cause the outer sleeve to engage at least one of the first and second wellbore casings and cause the inner sleeve to extend out of the outer sleeve into the second wellbore casing to cause the tubular expansion cone to radially expand and plastically deform the at least a portion of the second wellbore casing.

5. The method of claim 4, further comprising:

conveying fluidic materials within the borehole that are displaced by the extension of the inner sleeve to a location within the borehole above the tubular expansion cone.

6. The method of claim 1, wherein radially expanding and plastically deforming the overlapping portions of the first and second wellbore casings comprises:

positioning an outer tubular sleeve and an inner tubular sleeve comprising an expansion cone within the borehole, wherein the inner tubular sleeve is movably coupled to and at least partially housed within the outer tubular sleeve;

injecting a fluidic material into the inner and outer tubular sleeves;

coupling the outer tubular sleeve to the first wellbore casing; and extending the inner tubular sleeve out of the outer tubular sleeve into the overlapping portions of the first and second wellbore casings to radially expand and plastically the overlapping portions of the first and second wellbore casings using the expansion cone.

7. The method of claim 6, wherein injecting a fluidic material into the inner and outer tubular sleeves comprises:

injecting the fluidic material into an annular chamber above the expansion cone.

8. The method of claim 6, further comprising:

conveying fluidic materials within the borehole that are displaced by the extension of the inner tubular sleeve to a location above the expansion cone.

9. The method of claim 8 wherein conveying fluidic materials within the borehole that are displaced by the extension of the inner tubular sleeve to a location above the expansion cone comprises:

conveying fluidic materials within the borehole displaced by the extension of the inner tubular sleeve through an annular passage and one or more radial passages to the location above the expansion cone.

10. The method of claim 6, wherein radially expanding and plastically deforming at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

depressuring the inner and outer tubular sleeves;

decoupling the outer tubular sleeve and the first wellbore casing; and collapsing the outer tubular sleeve onto the inner tubular sleeve.

11. The method of claim 10, wherein radially expanding and plastically deforming at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing further comprises:

injecting a fluidic material into the inner and outer tubular sleeves;

coupling the outer tubular sleeve to at least one of the first and second wellbore casings;

extending the inner tubular sleeve out of the outer tubular sleeve into the second wellbore casing to radially expand and plastically deform the at least a portion of the second wellbore casing.

12. The method of claim 11, wherein injecting a fluidic material into the inner and outer tubular sleeves to radially expand and plastically deform at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

injecting the fluidic material into an annular chamber above the expansion cone.

13. The method of claim 11, further comprising:

conveying fluidic materials within the borehole that are displaced by the extension of the inner tubular sleeve to a location above the expansion cone.

14. The method of claim 13, wherein conveying fluidic materials within the borehole that are displaced by the extension of the inner tubular sleeve to the location above the expansion cone comprises:

conveying fluidic materials within the borehole displaced by the extension of the inner tubular sleeve through an annular passage and one or more radial passages to the location above the expansion cone.

15. An apparatus for forming a mono diameter wellbore casing, comprising:

means for positioning a first wellbore casing within a borehole;

means for radially expanding and plastically deforming the first wellbore casing within the borehole;

means for positioning a second wellbore casing within the borehole in overlapping relation to the first wellbore casing;

means for radially expanding and plastically deforming the second wellbore casing within the borehole so that the second wellbore casing comprises a first configuration in which the inside diameter of the overlapping portion of the second wellbore casing is less than the inside diameter of the portion of the first wellbore casing that does not overlap with the second wellbore casing; and means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing.

16. The apparatus of claim 15, wherein means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

means for positioning a telescoping radial expansion device comprising an outer sleeve and an inner sleeve positioned within and movably coupled to the outer sleeve comprising a tubular expansion cone proximate the end of the second wellbore casing; and means for injecting a fluidic material into the telescoping radial expansion device to cause the outer sleeve to engage the first wellbore casing and cause the inner sleeve to extend out of the outer sleeve into the overlapping portions of the first and second wellbore casings to cause the tubular expansion cone to radially expand and plastically deform the overlapping portions of the first and second wellbore casings.

17. The method of claim 16, further comprising:

conveying fluidic materials within the borehole that are displaced by the extension of the inner sleeve to a location within the borehole above the tubular expansion cone.

18. The apparatus of claim 16, wherein means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

means for reducing the operating pressure within the telescoping radial expansion device;

means for moving the outer sleeve onto the inner sleeve of the telescoping radial expansion device; and means for injecting a fluidic material into the telescoping radial expansion device to cause the outer sleeve to engage at least one of the first and second wellbore casings and cause the inner sleeve to extend out of the outer sleeve into the second wellbore casing to cause the tubular expansion cone to radially expand and plastically deform the at least a portion of the second wellbore casing.

19. The method of claim 18, further comprising:

conveying fluidic materials within the borehole that are displaced by the extension of the inner sleeve to a location within the borehole above the tubular expansion cone.

20. The apparatus of claim 15, wherein means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

means for positioning an outer tubular sleeve and an inner tubular sleeve comprising an expansion cone within the borehole, wherein the inner tubular sleeve is movably coupled to and at least partially housed within the outer tubular sleeve;

means for injecting a fluidic material into the inner and outer tubular sleeves;

means for coupling the outer tubular sleeve to at least one of the first and second wellbore casings; and means for extending the inner tubular sleeve out of the outer tubular sleeve into the overlapping portions of the first and second wellbore casings.

21. The apparatus of claim 20, wherein means for injecting a fluidic material into the inner and outer tubular sleeves comprises:

means for injecting the fluidic material into an annular chamber above the expansion cone.

22. The apparatus of claim 20, further comprising:

means for conveying fluidic materials within the borehole that are displaced by the extension of the inner tubular sleeve to a location above the expansion cone.

23. The apparatus of claim 22, wherein means for conveying fluidic materials within the borehole that are displaced by the extension of the inner tubular sleeve to a location above the expansion cone comprises:

means for conveying fluidic materials within the borehole displaced by the extension of the inner tubular sleeve through an annular passage and one or more radial passages to the location above the expansion cone.

24. The apparatus of claim 20, wherein means for radially expanding and plastically deforming the overlapping portions of the first and second wellbore casings and at least a portion of the second wellbore casing that does not overlap with the first wellbore casing so that the inside diameter of the portion of the first wellbore casing that does not overlap with the second wellbore casing is equal to the inside diameter of the overlapping portion and the at least a portion of the second wellbore casing further comprises:

means for depressuring the inner and outer tubular sleeves;

means for decoupling the outer tubular sleeve and the at least one of the first and second wellbore casings; and means for collapsing the outer tubular sleeve onto the inner tubular sleeve.

25. The apparatus of claim 24, further comprising:

means for conveying fluidic materials within the borehole that are displaced by the extension of the inner tubular sleeve to a location above the expansion cone.

26. The apparatus of claim 25, wherein means for conveying fluidic materials within the borehole that are displaced by the extension of the inner tubular sleeve to a location above the expansion cone comprises:

means for conveying fluidic materials within the borehole displaced by the extension of the inner tubular sleeve through an annular passage and one or more radial passages to the location above the expansion cone.

27. The apparatus of claim 15, wherein means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

a tubular adapter defining a longitudinal passage;

a tubular outer sleeve coupled to the tubular adapter defining a longitudinal passage;

a tubular hydraulic slip body coupled to the tubular outer sleeve defining a plurality of bypass ports and a plurality of radial hydraulic slip mounting passages;

a plurality of hydraulic slips movably coupled and positioned within corresponding radial hydraulic slip mounting passages for engaging at least one of the first and second wellbore casings;

a tubular packer cup mandrel coupled to the tubular hydraulic slip body defining a longitudinal passage;

a plurality of packer cups coupled to the tubular packer cup mandrel for sealingly engaging at least one of the first and second wellbore casings;

a tubular shoe positioned within and movably coupled to the tubular outer sleeve defining a longitudinal passage;

a tubular inner mandrel positioned within and movably coupled to the tubular hydraulic slip body coupled to the tubular shoe defining a longitudinal passage and a plurality of radial bypass ports;

an expansion device mandrel coupled to the tubular inner mandrel defining a longitudinal passage having a throat passage for receiving a ball, a bypass port, and a radial pressure port;

an expansion device coupled to the tubular expansion device mandrel including one or more tapered outer expansion surfaces for radially expanding and plastically deforming the at least one of the first and second wellbore casings;

a tubular guide nose coupled to the tubular expansion device mandrel defining a longitudinal passage;

a bypass tube positioned within the tubular inner mandrel coupled to the expansion device mandrel and the tubular shoe defining a longitudinal passage; and an annular longitudinal bypass passage defined between the tubular inner mandrel and the bypass tube.

28. The apparatus of claim 27, wherein the longitudinal passages of the tubular adapter, bypass tube, and expansion device mandrel are fluidicly coupled.

29. The apparatus of claim 27, wherein the longitudinal passages of the expansion device mandrel is fluidicly coupled to the radial pressure port of the expansion device mandrel.

30. The apparatus of claim 27, wherein the bypass port of the expansion device mandrel is fluidicly coupled to the annular longitudinal bypass passage, the radial bypass passages of the tubular inner mandrel, the bypass ports of the tubular hydraulic slip body, and the radial bypass ports of the tubular outer sleeve.

31. The apparatus of claim 15, wherein means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

a tubular support member defining a longitudinal passage;

a tubular outer sleeve coupled to the tubular support member defining a longitudinal passage and a plurality of radial bypass ports;

an hydraulic slip coupled to the tubular outer sleeve for controllably engaging at least one of the first and second wellbore casings;

one or more packer cups coupled to the tubular outer sleeve for sealingly engaging at least one of the first and second wellbore casings;

a tubular inner sleeve positioned within and movably coupled to the tubular outer sleeve defining a longitudinal passage, an annular longitudinal bypass passage, and one or more radial bypass passages; and a tubular expansion device coupled to the tubular inner sleeve defining a longitudinal passage having a throat passage for receiving a ball, a bypass pod, and a radial pressure port including one or more tapered outer expansion surfaces for radially expanding and plastically deforming at least a portion of at least one of the first and second wellbore casings.

32. The apparatus of claim 31, wherein the longitudinal passages of the tubular outer sleeve and the tubular expansion device are fluidicly coupled.

33. The apparatus of claim 31, wherein the longitudinal passage of the tubular expansion device is fluidicly coupled to the radial pressure pod of the tubular expansion device.

34. The apparatus of claim 31, wherein the bypass pod of the tubular expansion device is fluidicly coupled to the annular longitudinal bypass passage and the radial bypass passages of the tubular inner sleeve, and the bypass ports and the radial bypass ports of the tubular outer sleeve.

35. The apparatus of claim 15, wherein means for radially expanding and plastically deforming the overlapping portions of the first and second wellbore casings and at least a portion of the second wellbore casing that does not overlap with the first wellbore casing so that the second wellbore casing comprises a second configuration in which the inside diameter of the overlapping portion and the at least a portion of the second wellbore casing is equal to the inside diameter of the portion of the first wellbore casing that does not overlap with the second wellbore casing comprises:

a tubular adapter defining a longitudinal passage;

a tubular outer sleeve coupled to the tubular adapter defining a longitudinal passage;

a tubular hydraulic slip body coupled to the tubular outer sleeve defining a plurality of radial hydraulic slip mounting passages;

a plurality of hydraulic slips movably coupled and positioned within corresponding radial hydraulic slip mounting passages for engaging at least one of the first and second wellbore casings;

a tubular packer cup mandrel coupled to the tubular hydraulic slip body defining a longitudinal passage;

a plurality of packer cups coupled to the tubular packer cup mandrel for sealingly engaging at least one of the first and second wellbore casings;

a tubular shoe positioned within and movably coupled to the tubular outer sleeve defining a longitudinal passage;

a tubular inner mandrel positioned within and movably coupled to the tubular hydraulic slip body coupled to the tubular shoe defining a longitudinal passage and a plurality of bypass ports;

an expansion device mandrel coupled to the tubular inner mandrel defining a longitudinal passage, a bypass port, and a radial pressure port; and a expansion device coupled to the tubular expansion device mandrel including one or more tapered outer expansion surfaces for radially expanding and plastically deforming the at least a portion of at least one of the first and second wellbore casings.

36. An apparatus for radially expanding and plastically deforming a tubular member, comprising:

a tubular adapter defining a longitudinal passage;

a tubular outer sleeve coupled to the tubular adapter defining a longitudinal passage;

a tubular hydraulic slip body coupled to the tubular outer sleeve defining a plurality of L-shaped bypass ports and a plurality of radial hydraulic slip mounting passages;

a plurality of hydraulic slips movably coupled and positioned within corresponding radial hydraulic slip mounting passages for engaging the tubular member;

a tubular packer cup mandrel coupled to the tubular hydraulic slip body defining a longitudinal passage;

a plurality of packer cups coupled to the tubular packer cup mandrel for sealingly engaging the tubular member;

a tubular shoe positioned within and movably coupled to the tubular outer sleeve defining a longitudinal passage;

a tubular inner mandrel positioned within and movably coupled to the tubular hydraulic slip body coupled to the tubular shoe defining a longitudinal passage and a plurality of radial bypass ports;

a tubular expansion cone mandrel coupled to the tubular inner mandrel defining a longitudinal passage having a throat passage for receiving a ball, an L-shaped bypass port, and a radial pressure port;

a tubular expansion cone coupled to the tubular expansion cone including a tapered outer expansion surface for radially expanding and plastically deforming the tubular member;

a tubular guide nose coupled to the tubular expansion cone mandrel defining a longitudinal passage;

a bypass tube positioned within the tubular inner mandrel coupled to the expansion cone mandrel and the tubular shoe defining a longitudinal passage; and an annular longitudinal bypass passage defined between the tubular inner mandrel and the bypass tube.

37. The apparatus of claim 36, wherein the longitudinal passages of the tubular adapter, bypass tube, and tubular expansion cone mandrel are fluidicly coupled.

38. The apparatus of claim 36, wherein the longitudinal passage of the tubular expansion cone mandrel is fluidicly coupled to the radial pressure port of the tubular expansion cone mandrel.

39. The apparatus of claim 36, wherein the L-shaped bypass port of the tubular expansion cone mandrel is fluidicly coupled to the annular longitudinal bypass passage, the radial bypass passages of the tubular inner mandrel, the L-shaped bypass ports of the tubular hydraulic slip body, and the radial bypass ports of the tubular outer sleeve.

40. An apparatus for radially expanding and plastically deforming a tubular member, comprising:

a tubular support member defining a longitudinal passage;

a tubular outer sleeve coupled to the tubular support member defining a longitudinal passage and a plurality of radial bypass ports;

an hydraulic slip coupled to the tubular outer sleeve for controllably engaging the tubular member;

one or more packer cups coupled to the tubular outer sleeve for sealingly engaging the tubular member;

a tubular inner sleeve positioned within and movably coupled to the tubular outer sleeve defining a longitudinal passage, an annular longitudinal bypass passage, and one or more radial bypass passages; and a tubular expansion cone coupled to the tubular inner sleeve defining a longitudinal passage having a throat passage for receiving a ball, an L-shaped bypass port, and a radial pressure port including an tapered outer expansion surface for radially expanding and plastically deforming the tubular member.

41. The apparatus of claim 40, wherein the longitudinal passages of the tubular outer sleeve and the tubular expansion cone are fluidicly coupled.

42. The apparatus of claim 40, wherein the longitudinal passage of the tubular expansion cone is fluidicly coupled to the radial pressure port of the tubular expansion cone.

43. The apparatus of claim 40, wherein the L-shaped bypass port of the tubular expansion cone is fluidicly coupled to the annular longitudinal bypass passage and the radial bypass passages of the tubular inner sleeve, and the L-shaped bypass ports and the radial bypass ports of the tubular outer sleeve.

* * * * *